US007151555B2

(12) United States Patent
Kaida et al.

(10) Patent No.: US 7,151,555 B2
(45) Date of Patent: Dec. 19, 2006

(54) CASSETTE FOR A THERMAL TRANSFER SHEET

(75) Inventors: Hidemasa Kaida, Tokyo-To (JP); Shinji Kometani, Tokyo-To (JP); Tatsuya Kita, Tokyo-To (JP)

(73) Assignee: Dai Nippon Printing Co. Ltd, Tokyo (JP)

( * ) Notice: Subject to any disclaimer, the term of this patent is extended or adjusted under 35 U.S.C. 154(b) by 231 days.

(21) Appl. No.: 10/901,017

(22) Filed: Jul. 28, 2004

(65) Prior Publication Data

US 2005/0052523 A1 Mar. 10, 2005

(30) Foreign Application Priority Data

| | | |
|---|---|---|
| Jul. 30, 2003 | (JP) | 2003-203892 |
| Sep. 8, 2003 | (JP) | 2003-315169 |
| Sep. 8, 2003 | (JP) | 2003-315435 |
| Sep. 8, 2003 | (JP) | 2003-315482 |

(51) Int. Cl.
*B41J 32/00* (2006.01)

(52) U.S. Cl. ..... 347/214

(58) Field of Classification Search ..... 347/214; 400/207, 208, 208.1, 248
See application file for complete search history.

(56) References Cited

U.S. PATENT DOCUMENTS

| | | | | |
|---|---|---|---|---|
| 5,492,422 | A * | 2/1996 | Kondo | 400/208.1 |
| 6,504,564 | B1 * | 1/2003 | Funaki et al. | 347/214 |
| 6,714,228 | B1 * | 3/2004 | Holland et al. | 347/214 |

* cited by examiner

*Primary Examiner*—K. Feggins
(74) *Attorney, Agent, or Firm*—Harness, Dickey & Pierce, P.L.C.

(57) ABSTRACT

A cassette 10 for a thermal transfer sheet according to the present invention includes a core holding member 11 having a take-up core holding part 12 for holding the take-up core 2 and a feeding core holding part 13 for holding the feeding core 3, and a pair of covers 20 and 21 for respectively covering the take-up core holding part 12 and the feeding core holding part 13. A rod 30 for guiding the thermal transfer sheet 5 is disposed on the core holding member 11. The rod 30 is positioned on the opposite side of the thermal head 5*b* relative to the thermal transfer sheet 5, and is positioned on the side of the core holding member 11 relative to the thermal transfer sheet 5.

17 Claims, 13 Drawing Sheets

CASSETTE FOR A THERMAL TRANSFER SHEET

BACKGROUND OF THE INVENTION

1. Field of the Invention

The present invention relates to a cassette for a thermal transfer sheet, for containing therein a sheet body including a thermal transfer sheet.

2. Background Art

A sheet body including a take-up core, a feeding core, and a thermal transfer sheet has been conventionally known. Such a sheet body is contained in a cassette for a thermal transfer sheet, which includes a core holding member having a take-up core holding part and a feeding core holding part, and a cover for covering the core holding member (see Patent Gazette of U.S. Pat. No. 5,110,228).

In the cassette, a thermal transfer sheet is drawn out from the feeding core and is taken up by the take-up core. In the meantime, the thermal transfer sheet is heated by a thermal head so that an image is transferred from the thermal transfer sheet to an image receiving sheet.

When the thermal transfer sheet is drawn out from the feeding core in the cassette, the thermal transfer sheet may touch an inner surface of the cassette, and thus the thermal transfer sheet may not be properly taken up by the take-up core. In order to prevent this, a rod for guiding the thermal transfer sheet can be disposed in the cassette. However, depending on the location of the rod, the rod may easily be detached from the cassette, or the rod may not suitably guide the thermal transfer sheet.

There has also been demand for a cassette for a thermal transfer sheet which can fixedly secure the cover on the core holding member.

SUMMARY OF THE INVENTION

The present invention is made in view of the above problems. An object of the present invention is to provide a cassette for a thermal transfer sheet which is able to smoothly guide a thermal transfer sheet by preventing the thermal transfer sheet from touching an inner surface of the cassette, and is also able to fixedly secure a cover on a core holding member.

The present invention is a cassette for a thermal transfer sheet, for containing therein a sheet body including a take-up core, a feeding core, and a thermal transfer sheet which is wound around the take-up core and the feeding core and is heated by a thermal head, comprising: a core holding member including a take-up core holding part, a feeding core holding part, and a pair of connecting parts connecting the take-up core holding part and the feeding core holding part; covers for respectively covering the take-up core holding part and the feeding core holding part; and a rod disposed between the pair of connecting parts of the core holding member, for guiding the thermal transfer sheet by supporting the sheet; wherein the rod is positioned on the opposite side of the thermal head relative to the thermal transfer sheet, and is positioned on the side of the core holding member relative to the thermal transfer sheet.

In the cassette for a thermal transfer sheet, open supporting parts for supporting the rod are respectively disposed on the pair of connecting parts of the core holding member, and openings of the open supporting parts are covered with sealing ribs formed on the cover.

In the cassette for a thermal transfer sheet, each of the take-up core holding part and the feeding core holding part is provided with an open bearing which is opened to hold the corresponding take-up core or the feeding core.

In the cassette for a thermal transfer sheet, recessed rails are formed on an inner surface of the core holding member, and projections to be fitted in the recessed rails are formed on the respective covers.

The present invention is a cassette for a thermal transfer sheet, for containing therein a sheet body including a take-up core, a feeding core, and a thermal transfer sheet which is wound around the take-up core and the feeding core and is heated by a thermal head, comprising: a core holding member including a take-up core holding part, a feeding core holding part, and a pair of connecting parts connecting the take-up core holding part and the feeding core holding part; and covers for respectively covering the take-up core holding part and the feeding core holding part; wherein each of the covers is provided with claws, the core holding member is provided with openings in which the claws are fitted to secure the respective covers to the core holding member, and the openings of the core holding member are positioned near a beam member for reinforcing the core holding member.

In the cassette for a thermal transfer sheet, the beam member is formed by the take-up core holding part.

In the cassette for a thermal transfer sheet, the beam member is formed by the feeding core holding part.

In the cassette for a thermal transfer sheet, the beam member is disposed on the core holding member separately from the take-up core holding part and the feeding core holding part.

The present invention is a cassette for a thermal transfer sheet, for containing therein a sheet body including a take-up core, a feeding core, and a thermal transfer sheet which is wound around the take-up core and the feeding core and is heated by a thermal head, comprising: a core holding member including a take-up core holding part and a feeding core holding part; and covers for respectively covering the take-up core holding part and the feeding core holding part; wherein the core holding member is provided with a pair of side parts extending from the feeding core holding part to the take-up core holding part, and each of the covers is secured inside the pair of side parts.

In the cassette for a thermal transfer sheet, the pair of side parts are respectively made of flat plates.

In the cassette for a thermal transfer sheet, each of the covers is provided with a pair of side plates, and the pair of side plates of the cover are locked inside the pair of side parts of the core holding member.

The present invention is a cassette for a thermal transfer sheet, for containing therein a sheet body including a take-up core, a feeding core, and a thermal transfer sheet which is wound around the take-up core and the feeding core and is heated by a thermal head, comprising: a core holding member including a take-up core holding part, a feeding core holding part, and a pair of connecting parts connecting the take-up core holding part and the feeding core holding part; and covers for respectively covering the take-up core holding part and the feeding core holding part; wherein each of the take-up core holding part and the feeding core holding part of the core holding member is provided with a spring holder, and a spring is provided within the spring holder for pushing the corresponding core in one direction.

In the cassette for a thermal transfer sheet, the spring comprises a flat spring portion and a pair of shoulder portions disposed on both sides of the flat spring portion.

In the cassette for a thermal transfer sheet, each of the shoulder portions is provided with a cutout to be engaged with the spring holder to position the spring.

In the cassette for a thermal transfer sheet, the flat spring portion of the spring is provided with an outwardly projecting projection, the spring holder is provided with a hole to be engaged with the projection of the flat spring portion, and the spring is secured on the spring holder by fitting the projection in the hole.

In the cassette for a thermal transfer sheet, each of the take-up core holding part and the feeding core holding part of the core holding member is provided with an aperture through which an observer is able to observe whether the projection of the spring is fitted in the hole of the spring holder.

In the cassette for a thermal transfer sheet, upper ends of the shoulder portions are positioned above an upper end of the flat spring portion.

DETAILED DESCRIPTION OF THE INVENTION

First Embodiment

Figure 1:
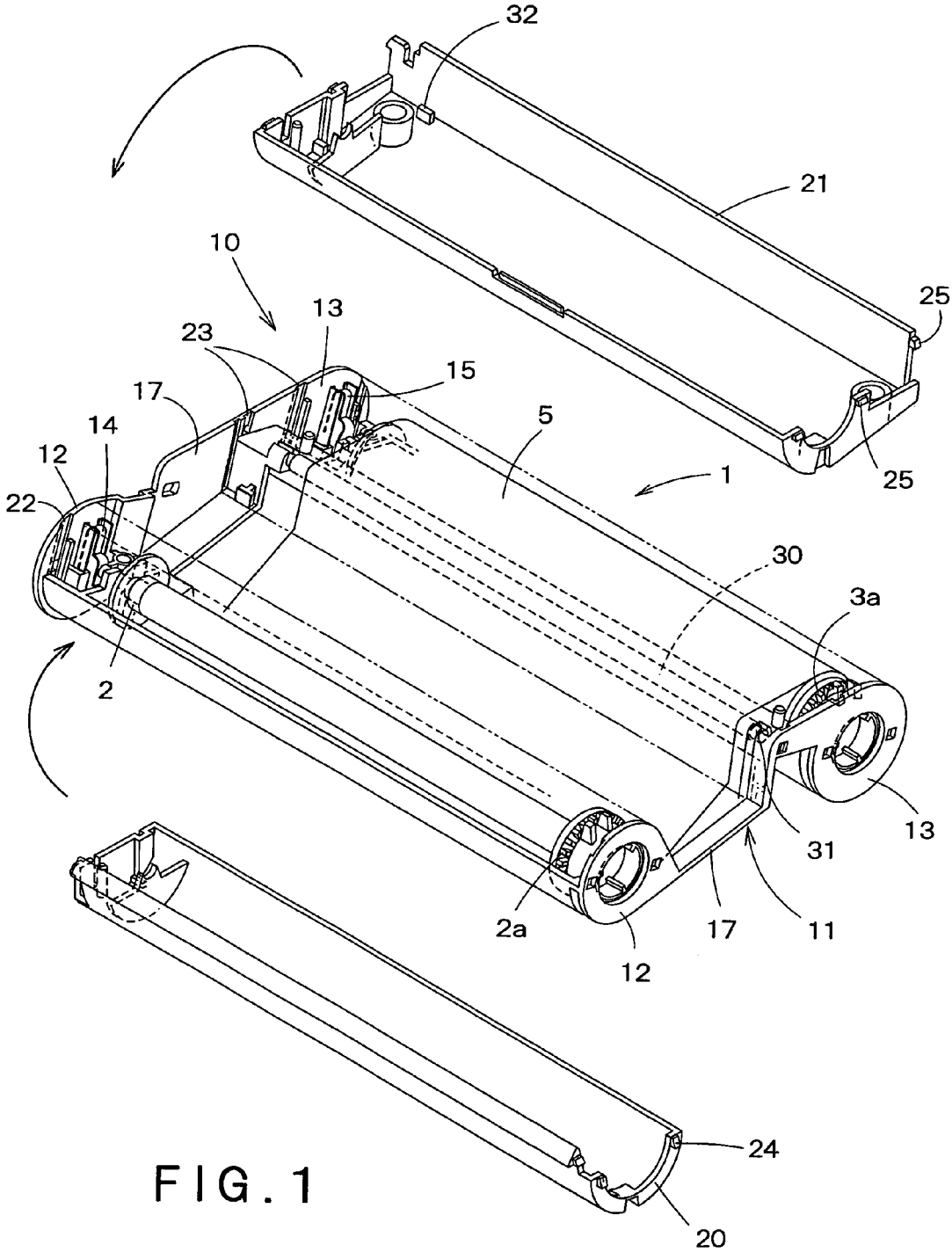
FIG. 1 is a perspective view showing a first embodiment of a cassette for a thermal transfer sheet according to the present invention.

A first embodiment of the present invention is described below with reference to the drawings.

FIGS. 1 to 6 show a cassette for a thermal transfer sheet of a first embodiment according to the present invention.

As shown in FIGS. 1 to 6, a cassette 10 for a thermal transfer sheet contains therein a sheet body 1 including a take-up core 2, a feeding core 3, and a thermal transfer sheet 5 wound around the take-up core 2 and the feeding core 3.

Figure 6:
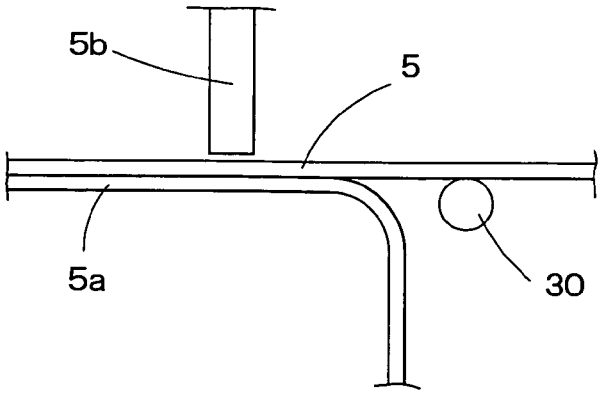
FIG. 6 is a view showing a positional relationship of a thermal transfer sheet, a rod, and a thermal head.
Figure 7:
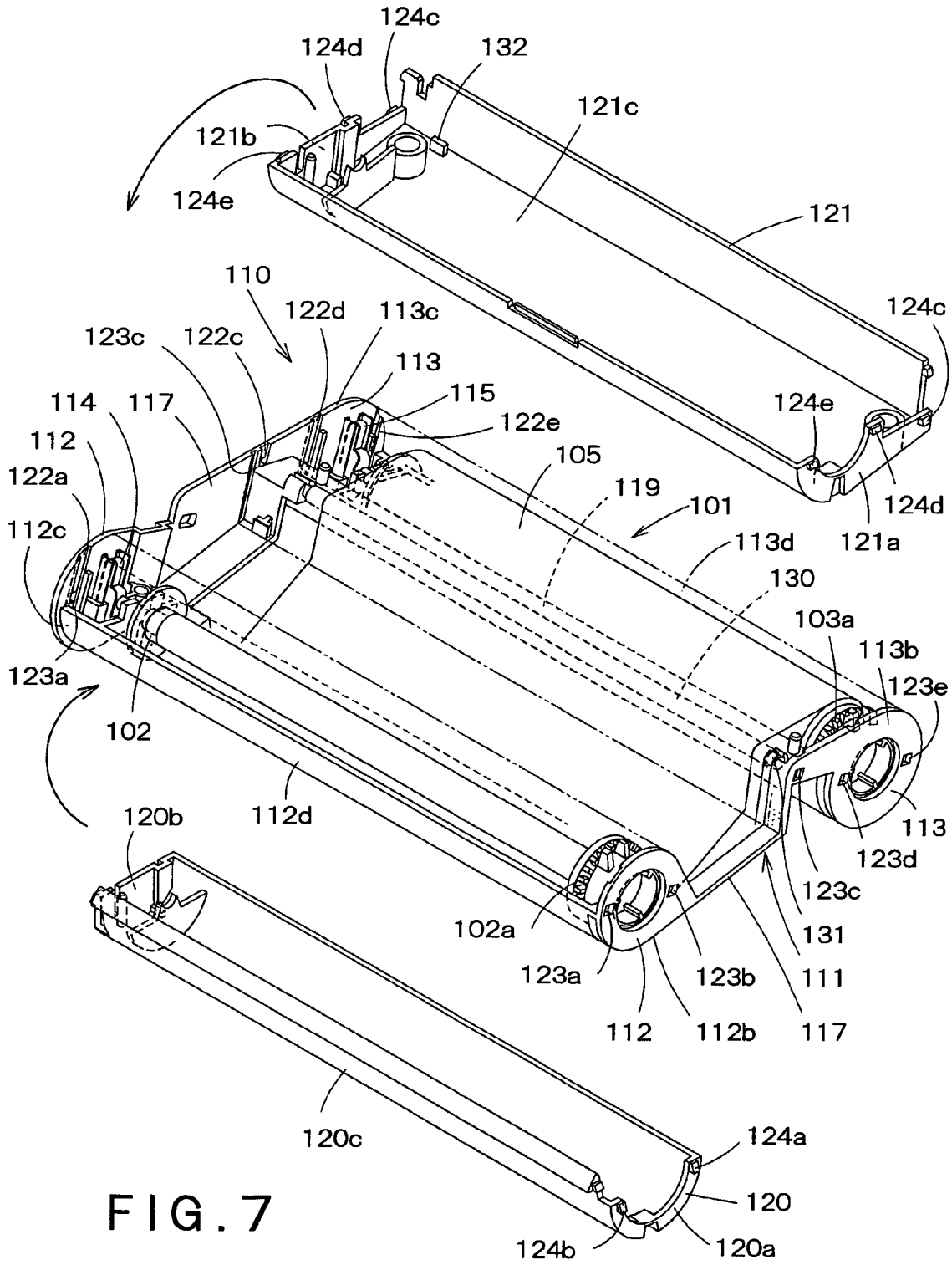
FIG. 7 is a perspective view showing a second embodiment of a cassette for a thermal transfer sheet according to the present invention.

The thermal transfer sheet 5 in the cassette 10 for a thermal transfer sheet is drawn out from the feeding core 3 and is taken up by the take-up core 2. In the meantime, the thermal transfer sheet 5 is heated by a thermal head 5*b*, so that an image is transferred from the thermal transfer sheet 5 to an image receiving sheet 5*a* (FIG. 6).

The take-up core 2 and the feeding core 3 have flanges 2*b* and 3*b*, respectively. The take-up core 2 and the feeding core 3 have ratchets 2*a* and 3*a* for positioning, respectively.

The cassette 10 for a thermal transfer sheet for containing therein the sheet body 1 as constituted above includes a core holding member 11 having a take-up core holding part 12 for holding the take-up core 2, a feeding core holding part 13 for holding the feeding core 3, and a pair of connecting parts 17 connecting the take-up core holding part 12 and the feeding core holding part 13; and a pair of covers 20 and 21 for respectively covering the take-up core holding part 12 and the feeding core holding part 13 of the core holding member 11.

The cover 20 covers the take-up core holding part 12, while the cover 21 covers the feeding core holding part 13.

The take-up core holding part 12 of the core holding member 11 has an open bearing 12*a* which is upwardly opened to hold a shaft 2*c* of the take-up core 2. The feeding core holding part 13 has an open bearing 13*a* which is upwardly opened to hold a shaft 3*c* of the feeding core 3.

The open bearings 12*a* and 13*a* are upwardly opened to respectively receive and support the shaft 2*c* of the take-up core 2 and the shaft 3*c* of the feeding core 3 which are fitted in the open bearings 12*a* and 13*a* from above.

A rod 30 is disposed between the pair of connecting parts 17 of the core holding member 11, for guiding the thermal transfer sheet 5 by supporting the sheet 5. The rod 30 is positioned on the opposite side of the thermal head 5*b* relative to the thermal transfer sheet 5, and is positioned on the side of the core holding member 11 relative to the thermal transfer sheet 5 (FIG. 6).

The rod 30 is rotatably supported by open supporting parts 31 which are upwardly opened and disposed on the pair of connecting parts 17, respectively. Openings of the open supporting parts 31 are covered and sealed by sealing ribs 32 formed inside the cover 21.

Since the rod 30 is positioned on the opposite side of the thermal head 5*b* relative to the thermal transfer sheet 5, and is positioned on the side of the core holding member 11 relative to the thermal transfer sheet 5, when the thermal transfer sheet 5 is pushed by the thermal head 5*b*, the rod 30 is also pushed toward the core holding member 11. That is, when the thermal transfer sheet 5 is pushed by the thermal head 5*b*, the rod 30 is not pushed outward the core holding member 11. Thus, the rod 30 is prevented from being detached from the core holding member 11.

The rod 30 is held in the open supporting parts 31. Thus, the rod 30 can be readily received in the open supporting parts 31, simply by inserting the rod 30 to the open supporting parts 31 from above. In addition, simply by covering the feeding core holding part 13 of the core holding member 11 with the cover 21, the rod 30 can be held by the open supporting parts 31 and the sealing ribs 32, with the open supporting parts 31 being sealed by the sealing ribs 32 formed on the cover 21.

Figure 2:
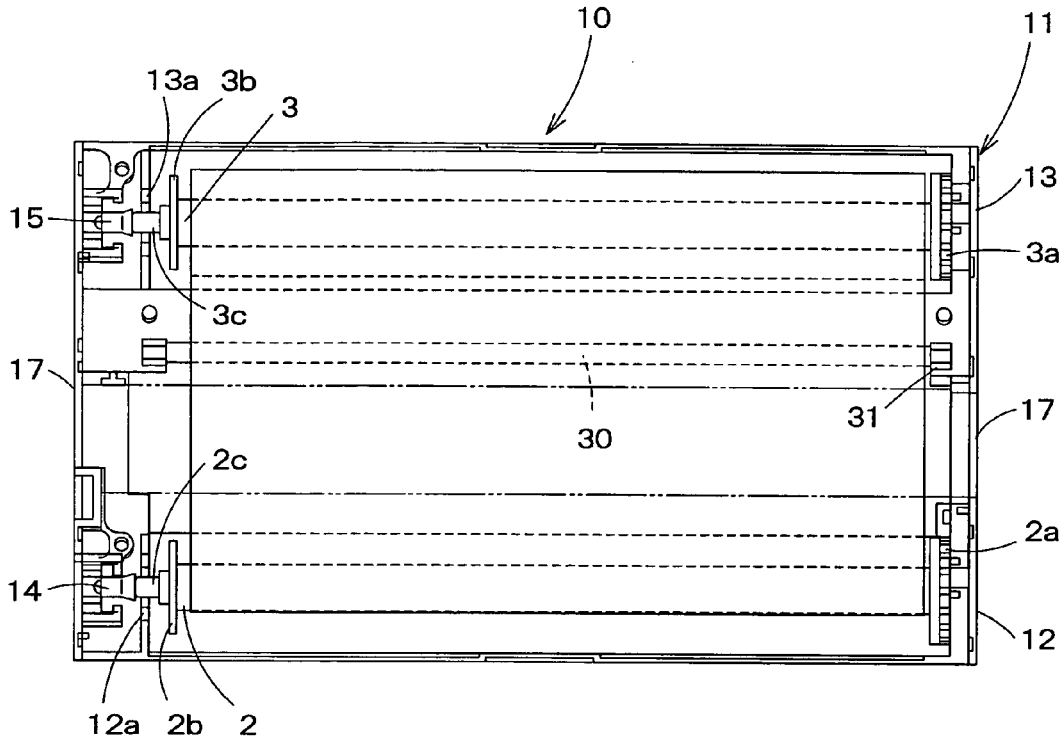
FIG. 2 is a plan view of the cassette for a thermal transfer sheet.
Figure 3:
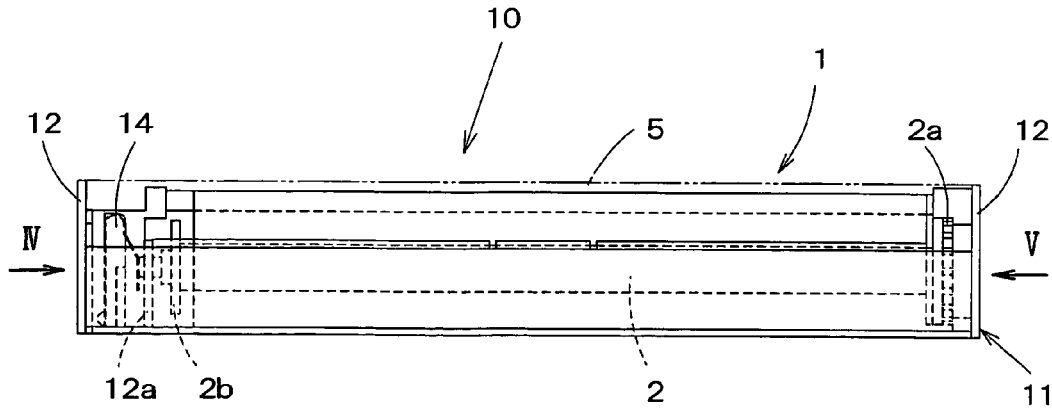
FIG. 3 is a front view of the cassette for a thermal transfer sheet.
Figure 4:
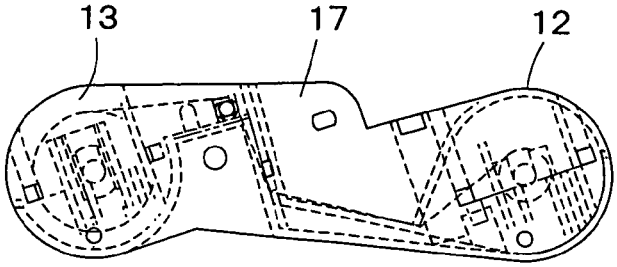
FIG. 4 is a side view of FIG. 3 viewed from the IV direction.
Figure 5:
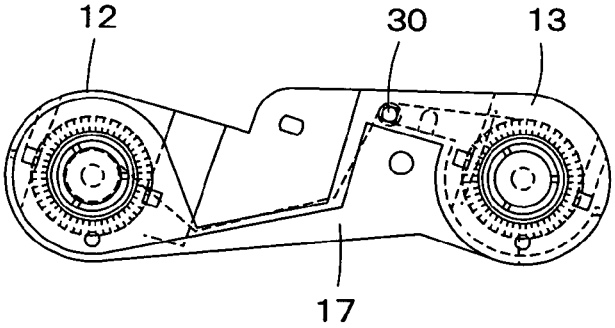
FIG. 5 is a side view of FIG. 3 viewed from the V direction.

As shown in FIGS. 2 and 3, a spring 14 is disposed on one side (left side in the drawings) of the take-up core holding part 12, which pushes the take-up core 2 to the other side (right side). A spring 15 is disposed on one side (left side) of the feeding core holding part 13, which pushes the feeding core 3 to the other side (right side). The spring 14 is disposed between a wall surface of the take-up core holding part 12 and an end of the take-up core 2. The spring 15 is disposed between a wall surface of the feeding core holding part 13 and an end of the feeding core 3.

For driving the thermal transfer sheet 5, driving mechanisms (not shown) are inserted from the other sides (right sides) of the take-up core holding part 12 and the feeding core holding part 13. The driving mechanisms move the take-up core 2 and the feeding core 3 to the left side in FIGS. 2 and 3, in spite of the force of the springs 14 and 15. Then, the take-up core 2 and the feeding core 3 are driven in rotation.

When the driving of the thermal transfer sheet 5 is stopped, the driving mechanisms come away from the take-up core 2 and the feeding core 3, which are in turn moved right side in FIGS. 2 and 3 by the force of the springs 14 and 15. Then, the ratchets 2*a* and 3*a* of the take-up core 2 and the feeding core 3 are respectively engaged with a corresponding engagement portion (not shown) of the take-up core holding part 12 and an engagement portion (not shown) of the feeding core holding part 13, so that the take-up core 2 and the feeding core 3 are locked.

Recessed rails 22 and 23 extending in a vertical direction are respectively formed on inner surfaces of the holding part 12 and the holding part 13 of the core holding member 11. Projections 24 and 25 to be fitted in the respective recessed rails 22 and 23 are disposed on the covers 20 and 21. When the core holding member 11 is covered with the covers 20 and 21, the projections 24 and 25 of the covers 20 and 21 are fitted in the corresponding recessed rails 22 and 23 of the holding part 12 and the holding part 13. Thus, the holding part 12 and the holding part 13 of the core holding member 11 can be smoothly covered with the covers 20 and 21.

An operation of the first embodiment as constituted above is described below.

The rod 30 is first mounted in the open supporting parts 31 of the core holding member 11. Then, the sheet body 1 having the take-up core 2, the feeding core 3, and the thermal transfer sheet 5 is mounted on the core holding member 11. The take-up core 2 and the feeding core 3 are inserted to the take-up core holding part 12 and the feeding core holding part 13, respectively.

As described above, since the open bearing 12*a* of the take-up core holding part 12 and the open bearing 13*a* of the feeding core holding part 13 are upwardly opened, the shaft 2*c* of the take-up core 2 and the shaft 3*c* of the feeding core 3 can be readily inserted to the open bearings 12*a* and 13*a*, simply by fitting the shaft 2*c* of the take-up core 2 and the shaft 3*c* of the feeding core 3 in the open bearings 12*a* and 13*a* from above.

Then, the take-up core holding part 12 of the core holding member 11 is covered with the cover 20, and the feeding core holding part 13 of the core holding member 11 is covered with the cover 21. Simply by fitting the projections 24 and 25 of the covers 20 and 21 in the recessed rails 22 and 23 of the holding part 12 and the holding part 13 of the core holding member 11, the take-up core holding part 12 and the feeding core holding part 13 can be smoothly covered with the covers 20 and 21. Since the open supporting parts 31 are sealed by the sealing ribs 32 of the cover 21, the rod 30 can be locked and held between the open supporting parts 31 and the sealing ribs 32.

In this manner, the sheet body 1 having the thermal transfer sheet 5 can be disposed and held in the cassette 10 for a thermal transfer sheet.

After the sheet body 1 is disposed in the cassette 10 for a thermal transfer sheet, the cassette 10 for a thermal transfer sheet is mounted on a printer. Then, the thermal transfer sheet 5 is heated by the thermal head 5*b* of the printer, so that an image is transferred from the transfer sheet 5 to the image receiving sheet 5*a* (FIG. 6).

Since the thermal transfer sheet 5 is guided by the rod 30 in the cassette 10 for a thermal transfer sheet, the thermal transfer sheet 5 is prevented from touching or abutting on the inner surface of the cassette 10. Thus, the thermal transfer sheet 5 can be smoothly drawn out from the feeding core 3 and taken up by the take-up core 2. Further, since the rod 30 is positioned on the opposite side of the thermal head 5*b* relative to the thermal transfer sheet 5, and is positioned on the side of the core holding member 11 relative to the thermal transfer sheet 5, when the thermal transfer sheet 5 is pushed by the thermal head 5*b*, the rod 30 is also pushed toward the core holding member 11. That is, when the thermal transfer sheet 5 is pushed by the thermal head 5*b*, the rod 30 is not pushed outward the core holding member 11. Thus, the rod 30 is prevented from being detached from the core holding member 11.

As described above, according to the present invention, since a thermal transfer sheet is smoothly guided by a rod, drawing and taking-up of the thermal transfer sheet can be smoothly carried out, without the thermal transfer sheet touching on an inner surface of a cassette. When the thermal transfer sheet is pushed by a thermal head, the rod is prevented from being detached outward.

Second Embodiment

A second embodiment of the present invention is described below with reference to the drawings.

FIGS. 7 to 12 show a cassette for a thermal transfer sheet of a second embodiment according to the present invention.

As shown in FIGS. 7 to 12, a cassette 110 for a thermal transfer sheet contains therein a sheet body 101 including a take-up core 102, a feeding core 103, and a thermal transfer sheet 105 wound around the take-up core 102 and feeding core 103.

Figure 12:
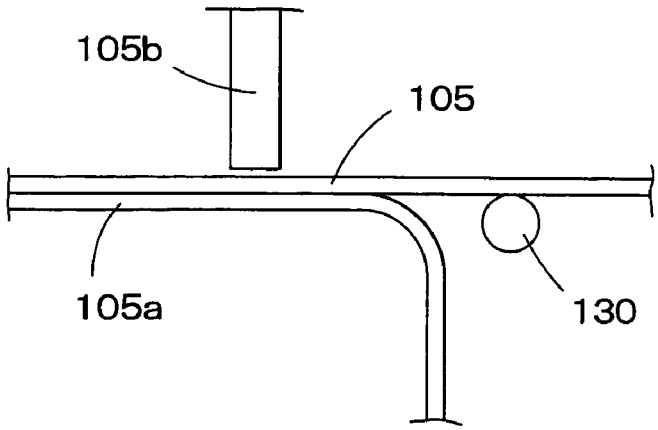
FIG. 12 is a view showing a positional relationship of a thermal transfer sheet, a rod, and a thermal head.
Figure 13:
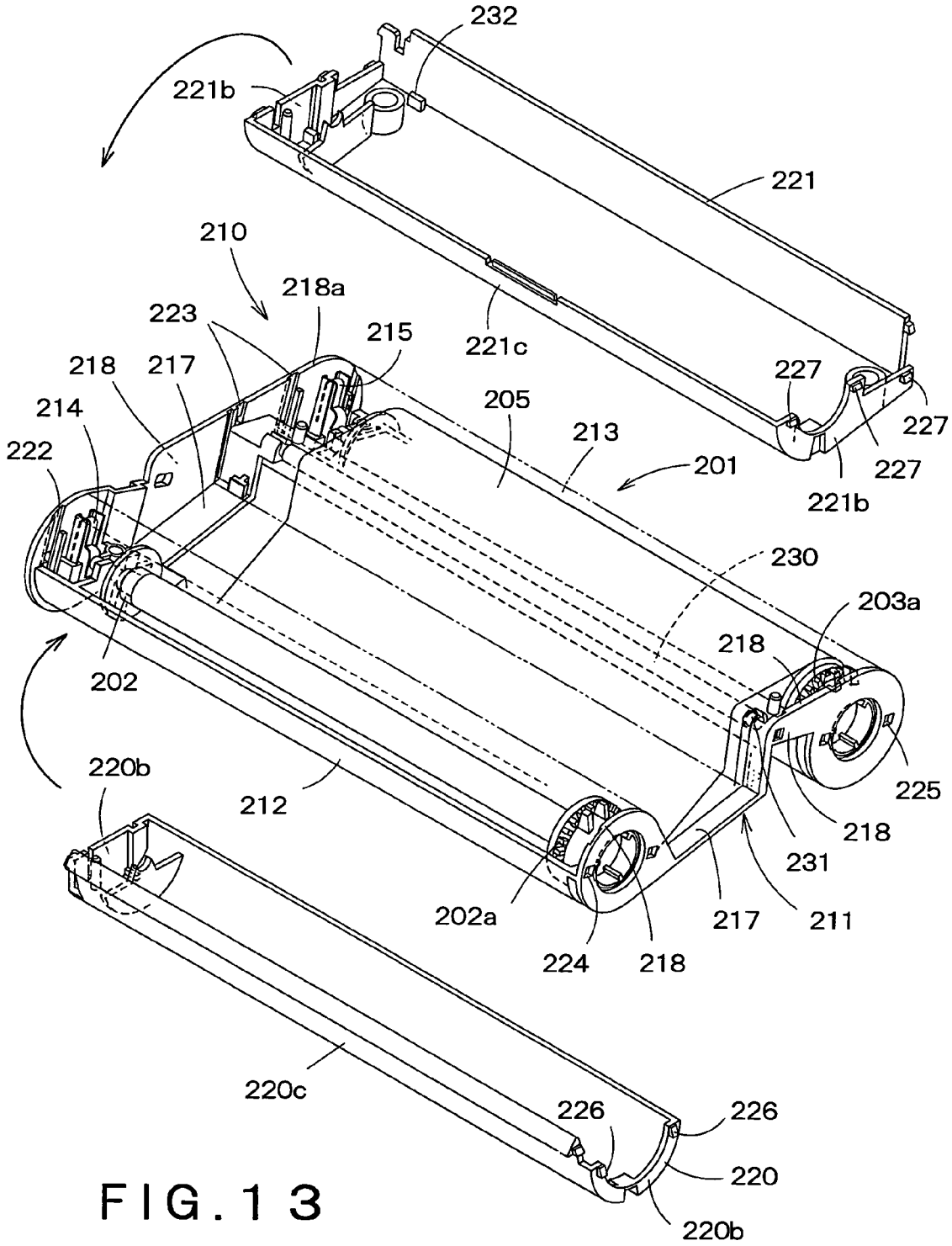
FIG. 13 is a perspective view showing a third embodiment of a cassette for a thermal transfer sheet according to the present invention.

The thermal transfer sheet 105 in the cassette 110 for a thermal transfer sheet is drawn out from the feeding core 103 and is taken up by the take-up core 102. In the meantime, the thermal transfer sheet 105 is heated by a thermal head 105*b*, so that an image is transferred from the thermal transfer sheet 105 to an image receiving sheet 105*a* (FIG. 12).

The take-up core 102 and the feeding core 103 have flanges 102*b* and 103*b*, respectively. The take-up core 102 and the feeding core 103 have ratchets 102*a* and 103*a* for positioning, respectively.

The cassette 110 for a thermal transfer sheet for containing therein the sheet body 101 as constituted above includes a core holding member 111 having a take-up core holding part 112 for holding the take-up core 102, a feeding core holding part 113 for holding the feeding core 103, and a pair of connecting parts 117 connecting the take-up core holding part 112 and the feeding core holding part 113; and a pair of covers 120 and 121 for respectively covering the take-up core holding part 112 and the feeding core holding part 113 of the core holding member 111.

The cover 120 covers the take-up core holding part 112, and has a pair of side parts 120*a* and 120*b*, and a middle part 120*c* connecting the side parts 120*a* and 120*b*. The cover 121 covers the feeding core holding part 113, and is formed of a pair of side parts 121*a* and 121*b*, and a middle part 121*c* connecting the side parts 121*a* and 121*b*.

The take-up core holding part 112 of the core holding member 111 is formed of a pair of side parts 112*b* and 112*c*, and a middle part 112*d* connecting the side parts 112*b* and 112*c*. The take-up core holding part 112 includes an open bearing 112*a* which is upwardly opened to hold a shaft 102*c* of the take-up core 102. The middle part 112*d* also serves as a beam member for reinforcing the core holding member 111. The feeding core holding part 113 of the core holding member 111 is formed of a pair of side parts 113*b* and 113*c*, and a middle part 113*d* connecting the side parts 113*b* and 113*c*. The feeding core holding part 113 includes an open bearing 113*a* which is upwardly opened to hold a shaft 103*c* of the feeding core 103. The middle part 113*d* also serves as a beam member for reinforcing the core holding member 111.

The open bearings 112*a* and 113*a* are upwardly opened to respectively receive and support the shaft 102*c* of the take-up core 102 and the shaft 103*c* of the feeding core 103, which are fitted in the open bearings 112*a* and 113*a* from above.

A rod 130 is disposed between the pair of connecting parts 117 of the core holding member 111, for guiding the thermal transfer sheet 105 by supporting the sheet 105. The rod 130 is positioned on the opposite side of the thermal head 105*b* relative to the thermal transfer sheet 105, and is positioned on the side of the core holding member 111 relative to the thermal transfer sheet 105 (FIG. 12).

The rod 130 is rotatably supported by open supporting parts 131 which are upwardly opened and disposed on the pair of connecting parts 117, respectively. Openings of the open supporting parts 131 are covered and sealed by sealing ribs 132 formed inside the cover 121.

Since the rod 130 is positioned on the opposite side of the thermal head 105*b* relative to the thermal transfer sheet 105, and is positioned on the side of the core holding member 111 relative to the thermal transfer sheet 105, when the thermal transfer sheet 105 is pushed by the thermal head 105*b*, the rod 130 is also pushed toward the core holding member 111. That is, when the thermal transfer sheet 105 is pushed by the thermal head 105*b*, the rod 130 is not pushed outward the core holding member 111. Thus, the rod 130 is prevented from being detached from the core holding member 111.

The rod 130 is held in the open supporting parts 131. Thus, the rod 130 can be readily received in the open supporting parts 131, simply by inserting the rod 130 to the open supporting parts 131 from above. In addition, simply by covering the feeding core holding part 113 of the core holding member 111 with the cover 121, the rod 130 can be held by the open supporting parts 131 and the sealing ribs 132, with the open supporting parts 131 being sealed by the sealing ribs 132 formed on the cover 121.

A beam member 119 connecting the pair of connecting parts 117 is disposed between the rod 130 and the feeding core holding part 113. The beam member 119 reinforces the core holding member 111, and enhances a rigidity of the core holding member 111 near the beam member 119.

Figure 8:
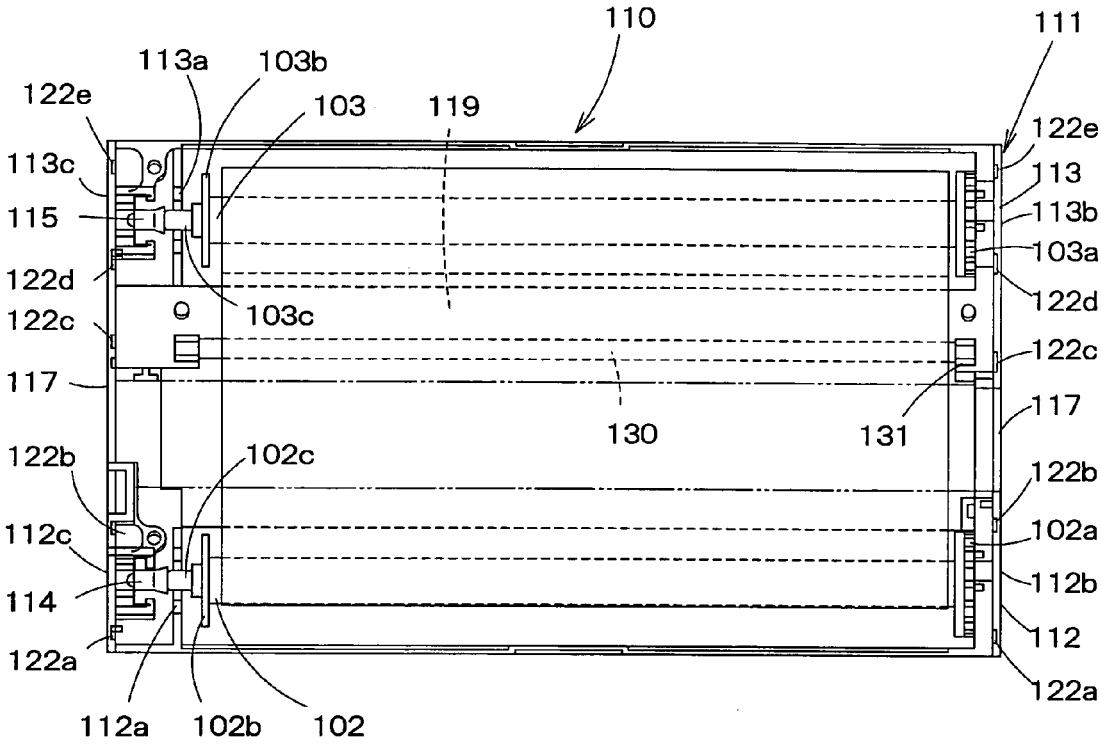
FIG. 8 is a plan view of the cassette for a thermal transfer sheet.
Figure 9:
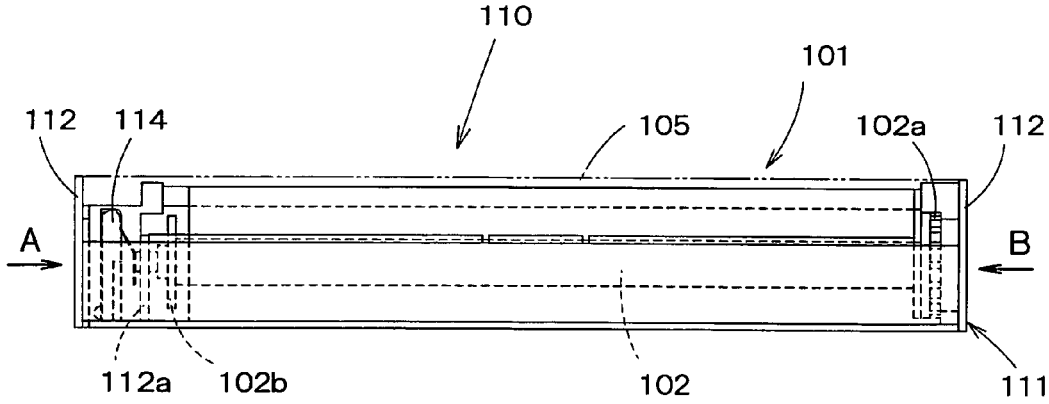
FIG. 9 is a front view of the cassette for a thermal transfer sheet.
Figure 10:
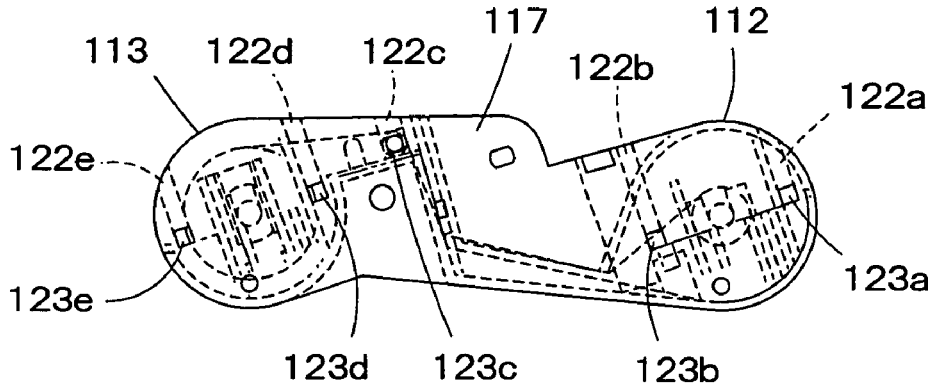
FIG. 10 is a side view of FIG. 9 viewed from the A direction.
Figure 11:
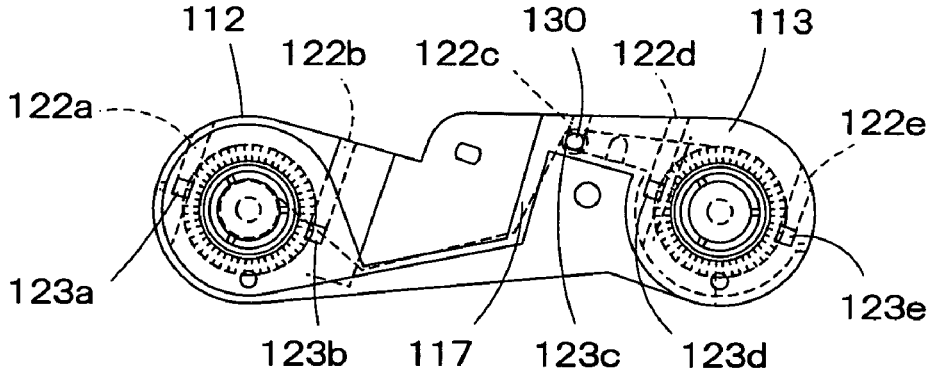
FIG. 11 is a side view of FIG. 9 viewed from the B direction.

As shown in FIGS. 8 and 9, a spring 114 is disposed on one side (left side in the drawings) of the take-up core holding part 112, which pushes the take-up core 102 to the other side (right side). A spring 115 is disposed on one side (left side) of the feeding core holding part 113, which pushes the feeding core 103 to the other side (right side). The spring 114 is disposed between the side part 112*c* of the take-up core holding part 112 and an end of the take-up core 102. The spring 115 is disposed between the side part 113*c* of the feeding core holding part 113 and an end of the feeding core 103.

For driving the thermal transfer sheet 105, driving mechanisms (not shown) are inserted from the side part 112*b* of the take-up core holding part 112 and from the side part 113*b* of the feeding core holding part 113. The driving mechanisms move the take-up core 102 and the feeding core 103 to the left side in FIGS. 8 and 9, in spite of the force of the springs 114 and 115. Then, the take-up core 102 and the feeding core 103 are driven in rotation.

When the driving of the thermal transfer sheet 105 is stopped, the driving mechanisms come away from the take-up core 102 and the feeding core 103, which are in turn moved right side in FIGS. 8 and 9 by the force of the springs 114 and 115. Then, the ratchets 102*a* and 103*a* of the take-up core 102 and the feeding core 103 are respectively engaged with a corresponding engagement portion (not shown) of the take-up core holding part 112 and an engagement portion (not shown) of the feeding core holding part 113, so that the take-up core 102 and the feeding core 103 are locked.

Recessed rails 122*a* and 122*b* extending in a vertical direction are respectively formed on inner surfaces of the side parts 112*b* and 112*c* of the holding part 112 of the core holding member 111. Recessed rails 122*c* extending in a vertical direction are formed on inner surfaces of the connecting parts 117 of the core holding member 111. Recessed rails 122*d* and 122*e* extending in a vertical direction are respectively formed on inner surfaces of the side parts 113*b* and 113*c* of the holding part 113 of the core holding member 111. The recessed rails 122*a*, 122*b*, 122*c*, 122*d*, and 122*e* are formed of recessed grooves of the same depth.

Openings 123*a* and 123*b* are respectively formed at ends of the recessed rails 122*a* and 122*b* of the take-up core holding part 112, near the middle part 112*d* of the holding part 112 which serves as a beam member for reinforcing the core holding member 111. Openings 123*c* are formed at ends of the recessed rails 122*c* of the connecting parts 117, near the beam member 119. Openings 123*d* and 123*e* are respectively formed at ends of the recessed rails 122*d* and 122*e* of the feeding core holding part 113, near the middle part 113*d* of the holding part 113 which serves as a beam member for reinforcing the core holding member 111.

The cover 120 is provided with claws 124*a* and 124*b* which are engaged with the recessed rails 122*a* and 122*b* formed on the holding part 112 of the core holding member 111, and are fitted in the openings 123*a* and 123*b* formed on the holding part 112 of the core holding member 111.

The cover 121 is provided with claws 124*c* which are engaged with the recessed rails 122*c* formed on the connecting parts 117 of the core holding member 111, and are fitted in the openings 123*c* formed on the connecting parts 117 of the core holding member 111. Further, the cover 121 is provided with claws 124*d* and 124*e* which are engaged with the recessed rails 122*d* and 122*e* formed on the holding part 113 of the core holding member 111, and are fitted in the openings 123*d* and 123*e* formed on the holding part 113 of the core holding member 111. The claws 124*a*, 124*b*, 124*c*, 124*d*, and 124*e* have the same height.

For covering the core holding part 111 with the covers 120 and 121, the claws 124*a*, 124*b*, 124*c*, 124*d*, and 124*e* of the covers 120 and 121 are guided by the corresponding recessed rails 122*a*, 122*b*, 122*c*, 122*d*, and 122*e* of the holding part 112, connecting parts 117, and the holding part 113 of the core holding member 111, and then the claws 124*a*, 124*b*, 124*c*, 124*d*, and 124*e* are fitted in the corresponding openings 123*a*, 123*b*, 123*c*, 123*d*, and 123*e* of the holding part 112, the connecting parts 117, and the holding part 113. Therefore, the core holding member 111 can be smoothly covered with the covers 120 and 121.

An operation of the second embodiment as constituted above is described below.

The rod 130 is first mounted in the open supporting parts 131 of the core holding member 111. Then, the sheet body 101 having the take-up core 102, the feeding core 103, and the thermal transfer sheet 105 is mounted on the core holding member 111. The take-up core 102 and the feeding core 103 are inserted to the take-up core holding part 112 and the feeding core holding part 113, respectively.

As described above, since the open bearing 112*a* of the take-up core holding part 112 and the open bearing 113*a* of the feeding core holding part 113 are upwardly opened, the shaft 102*c* of the take-up core 102 and the shaft 103*c* of the feeding core 103 can be readily inserted to the open bearings 112*a* and 113*a*, simply by fitting the shaft 102*c* of the take-up core 102 and the shaft 103*c* of the feeding core 103 in the open bearings 112*a* and 113*a* from above.

Then, the take-up core holding part 112 of the core holding member 111 is covered with the cover 120, and the feeding core holding part 113 of the core holding member 111 is covered with the cover 121. The claws 124*a*, 124*b*, 124*c*, 124*d*, and 124*e* of the covers 120 and 121 are first engaged with the recessed rails 122*a*, 122*b*, 122*c*, 122*d*, and 122*e* of the holding part 112, the connecting parts 117, and the holding part 113 of the core holding member 111. Then, the covers 120 and 121 are pushed toward the core holding member 111, whereby the claws 124*a*, 124*b*, 124*c*, 124*d*, and 124*e* of the covers 120 and 121 are slid along the recessed rails 122*a*, 122*b*, 122*c*, 122*d*, and 122*e*. Thereafter, the claws 124*a*, 124*b*, 124*c*, 124*d*, and 124*e* are fitted in the openings 123*a*, 123*b*, 123*c*, 123*d*, and 123*e* of the holding part 112, the connecting parts 117, and the holding part 113 of the core holding member 111.

The claws 124*a*, 124*b*, 124*c*, 124*d*, and 124*e* have the same height, and the recessed rails 122*a*, 122*b*, 122*c*, 122*d*, and 122*e* have the same groove depth. Thus, equal pushing forces are applied to the respective engagement portions between the claws 124*a*, 124*b*, 124*c*, 124*d*, and 124*e* and the recessed rails 122*a*, 122*b*, 122*c*, 122*d*, and 122*e*. Thus, the covers 120 and 121 can be smoothly secured on the take-up core holding part 112 and the feeding core holding part 113 of the core holding member 111.

Since the open supporting parts 131 are sealed by the sealing ribs 132 of the cover 121, the rod 130 can be locked and held between the open supporting parts 131 and the sealing ribs 132.

As described above, in the core holding member 111, the openings 123*a* and 123*b* are formed near the middle part 112*d* of the take-up core holding part 112, the openings 123*c* are formed near the beam member 119, and the openings 123*d* and 123*e* are formed near the middle part 113*d* of the feeding core holding part 113. The beam member 119 is disposed to reinforce the core holding member 111. The middle part 112*d* of the take-up core holding part 112 and the middle part 113*d* of the feeding core holding part 113 serve as beam members for reinforcing the core holding member 111. Thus, when an external force is applied to the cassette 110 for a thermal transfer sheet, it is unlikely that the core holding member 111 is deformed at the positions where the openings 123*a*, 123*b*, 123*c*, 123*d*, and 123*e* are formed. Therefore, the claws 124*a*, 124*b*, 124*c*, 124*d*, and 124*e* of the covers 120 and 121 are hardy detached from the openings 123*a*, 123*b*, 123*c*, 123*d*, and 123*e* of the core holding member 111. As a result, the covers 120 and 121 can be fixedly secured on the core holding member 111.

In this manner, the sheet body 101 having the transfer sheet 105 can be securely disposed and held in the cassette 110 for a thermal transfer sheet.

After the sheet body 101 is disposed in the cassette 110 for a thermal transfer sheet, the cassette 110 for a thermal transfer sheet is mounted on a printer. Then, the thermal transfer sheet 105 is heated by the thermal head 105*b* of the printer, so that an image is transferred from the transfer sheet 105 to the image receiving sheet 105*a* (FIG. 12).

Since the thermal transfer sheet 105 is guided by the rod 130 in the cassette 110 for a thermal transfer sheet, the thermal transfer sheet 105 is prevented from touching or abutting on the inner surface of the cassette 110. Thus, the thermal transfer sheet 105 can be smoothly drawn out from the feeding core 103 and taken up by the take-up core 102. Further, since the rod 130 is positioned on the opposite side of the thermal head 105*b* relative to the thermal transfer sheet 105, and is positioned on the side of the core holding member 111 relative to the thermal transfer sheet 105, when the thermal transfer sheet 105 is pushed by the thermal head 105*b*, the rod 130 is also pushed toward the core holding member 111. That is, when the thermal transfer sheet 105 is pushed by the thermal head 105*b*, the rod 130 is not pushed outward the core holding member 111. Thus, the rod 130 is prevented from being detached from the core holding member 111.

As described above, according to the present invention, in the core holding member 111, the openings 123*a*, 123*b* are formed near the middle part 112*d* of the take-up core holding part 112 which serves as a beam member for reinforcing the core holding member 111, the openings 123*c* are formed near the beam member 119 for reinforcing the core holding member 111, and the openings 123*d* and 123*e* are formed near the middle part 113*d* of the feeding core holding part 113 which serves as a beam member for reinforcing the core holding member 111. Therefore, when an external force is applied to the cassette 110 for a thermal transfer sheet, it is unlikely that the core holding member 111 is deformed at the positions where the openings 123*a*, 123*b*, 123*c*, 123*d*, and 123*e* are formed. Thus, the claws 124*a*, 124*b*, 124*c*, 124*d*, and 124*e* of the covers 120 and 121 are hardy detached from the openings 123*a*, 123*b*, 123*c*, 123*d*, and 123*e* of the core holding member 111. As a result, the covers 120 and 121 can be fixedly secured on the core holding member 111.

In addition, the claws 124*a*, 124*b*, 124*c*, 124*d*, and 124*e* have the same height, and the recessed rails 122*a*, 122*b*, 122*c*, 122*d*, and 122*e* have the same groove depth. Thus, when the claws 124*a*, 124*b*, 124*c*, 124*d*, and 124*e* are engaged with the recessed rails 122*a*, 122*b*, 122*c*, 122*d*, and 122*e*, and subsequently the covers 120 and 121 are pushed toward the core holding member 111, equal forces can be applied to the respective engagement portions between the claws 124*a*, 124*b*, 124*c*, 124*d*, and 124*e*, and the recessed rails 122*a*, 122*b*, 122*c*, 122*d*, and 122*e*. Therefore, the covers 120 and 121 can be smoothly secured on the core holding member 111.

According to the present invention, when an external force is applied to a cassette for a thermal transfer sheet, it is unlikely that a core holding member is deformed at positions where openings are formed. Thus, claws of covers are hardy detached from the openings. As a result, the covers can be fixedly secured on the core holding member. Further, since recessed rails for guiding the claws are formed adjacent to the openings, the covers can be readily secured on the core holding member, thus preventing an adverse effect to a thermal transfer sheet which might occur because of difficulty in securing covers.

Third Embodiment

A third embodiment of the present invention is described below with reference to the drawings.

FIGS. 13 to 18 show a cassette for a thermal transfer sheet of a third embodiment according to the present invention.

As shown in FIGS. 13 to 18, a cassette 210 for a thermal transfer sheet contains therein a sheet body 201 including a take-up core 202, a feeding core 203, and a thermal transfer sheet 205 wound around the take-up core 202 and feeding core 203.

Figure 18:
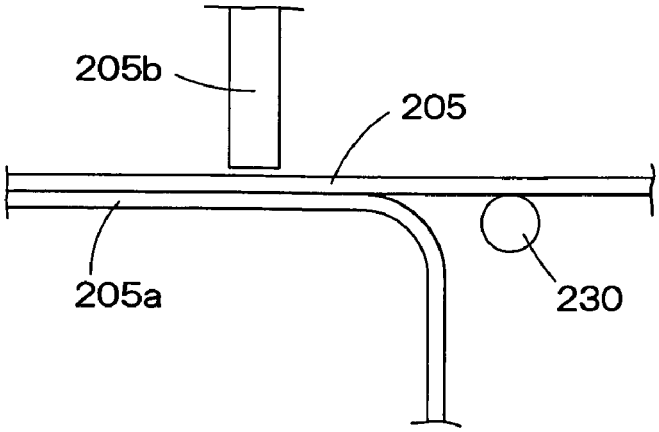
FIG. 18 is a view showing a positional relationship of a thermal transfer sheet, a rod, and a thermal head.
Figure 19:
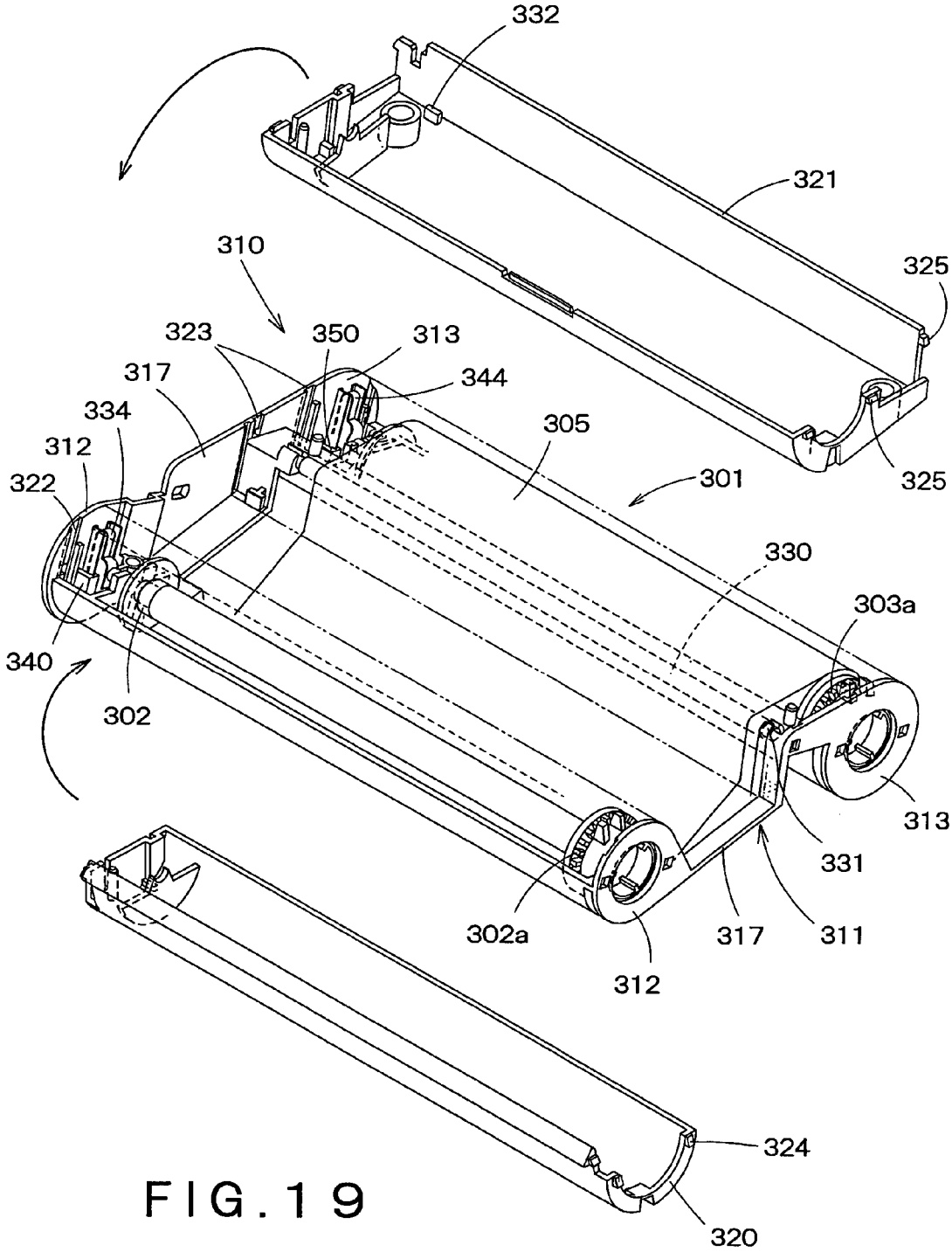
FIG. 19 is a perspective view showing a fourth embodiment of a cassette for a thermal transfer sheet according to the present invention.

The thermal transfer sheet 205 in the cassette 210 for a thermal transfer sheet is drawn out from the feeding core 203 and is taken up by the take-up core 202. In the mean time, the thermal transfer sheet 205 is heated by a thermal head 205*b*, so that an image is transferred from the thermal transfer sheet 205 to an image receiving sheet 205*a* (FIG. 18).

The take-up core 202 and the feeding core 203 have flanges 202*b* and 203*b*, respectively. The take-up core 202 and the feeding core 203 have ratchets 202*a* and 203*a* for positioning, respectively.

The cassette 210 for a thermal transfer sheet for containing therein the sheet body 201 as constituted above includes a core holding member 211 having a take-up core holding part 212 for holding the take-up core 202, a feeding core holding part 213 for holding the feeding core 203, and a pair of connecting parts 217 connecting the take-up core holding part 212 and the feeding core holding part 213; and a pair of covers 220 and 221 for respectively covering the take-up core holding part 212 and the feeding core holding part 213 of the core holding member 211. Side surfaces of the take-up core holding part 212, side surfaces of the feeding core holding part 213, and side surfaces of the connecting parts 217 are integrated to define a pair of plate-like side parts 218 extending from the take-up core holding part 212 to the feeding core holding part 213.

The cover 220 covers the take-up core holding part 212, and has a pair of side plates 220*b* and a middle part 220*c*. The cover 221 covers the feeding core holding part 213, and has a pair of side plates 221*b* and a middle part 221*c*.

The take-up core holding part 212 of the core holding member 211 includes an open bearing 212*a* which is upwardly opened to hold a shaft 202*c* of the take-up core 202. The feeding core holding part 213 has an open bearing 213*a* which is upwardly opened to hold a shaft 203*c* of the feeding core 203.

The open bearings 212*a* and 213*a* are upwardly opened to respectively receive and support the shaft 202*c* of the take-up core 202 and the shaft 203*c* of the feeding core 203, which are fitted in the open bearings 212*a* and 213*a* from above.

A rod 230 is disposed between the pair of connecting parts 217 of the core holding member 211, for guiding the thermal transfer sheet 205 by supporting the sheet 205. The rod 230 is positioned on the opposite side of the thermal head 205*b* relative to the thermal transfer sheet 205, and is positioned on the side of the core holding member 211 relative to the thermal transfer sheet 205 (FIG. 18).

The rod 230 is rotatably supported by open supporting parts 231 which are upwardly opened and disposed on the pair of connecting parts 217, respectively. Openings of the open supporting parts 231 are covered and sealed by sealing ribs 232 formed inside the cover 221.

Since the rod 230 is positioned on the opposite side of the thermal head 205*b* relative to the thermal transfer sheet 205, and is positioned on the side of the core holding member 211 relative to the thermal transfer sheet 205, when the thermal transfer sheet 205 is pushed by the thermal head 205*b*, the rod 230 is also pushed toward the core holding member 211. That is, when the thermal transfer sheet 205 is pushed by the thermal head 205*b*, the rod 230 is not pushed outward the core holding member 211. Thus, the rod 230 is prevented from being detached from the core holding member 211.

The rod 230 is held in the open supporting parts 231. Thus, the rod 230 can be readily received in the open supporting parts 231, simply by inserting the rod 230 to the open supporting parts 231 from above. In addition, simply by covering the feeding core holding part 213 of the core holding member 211 with the cover 221, the rod 230 can be held by the open supporting parts 231 and the sealing ribs 232, with the open supporting parts 231 being sealed by the sealing ribs 232 formed on the cover 221.

Figure 14:
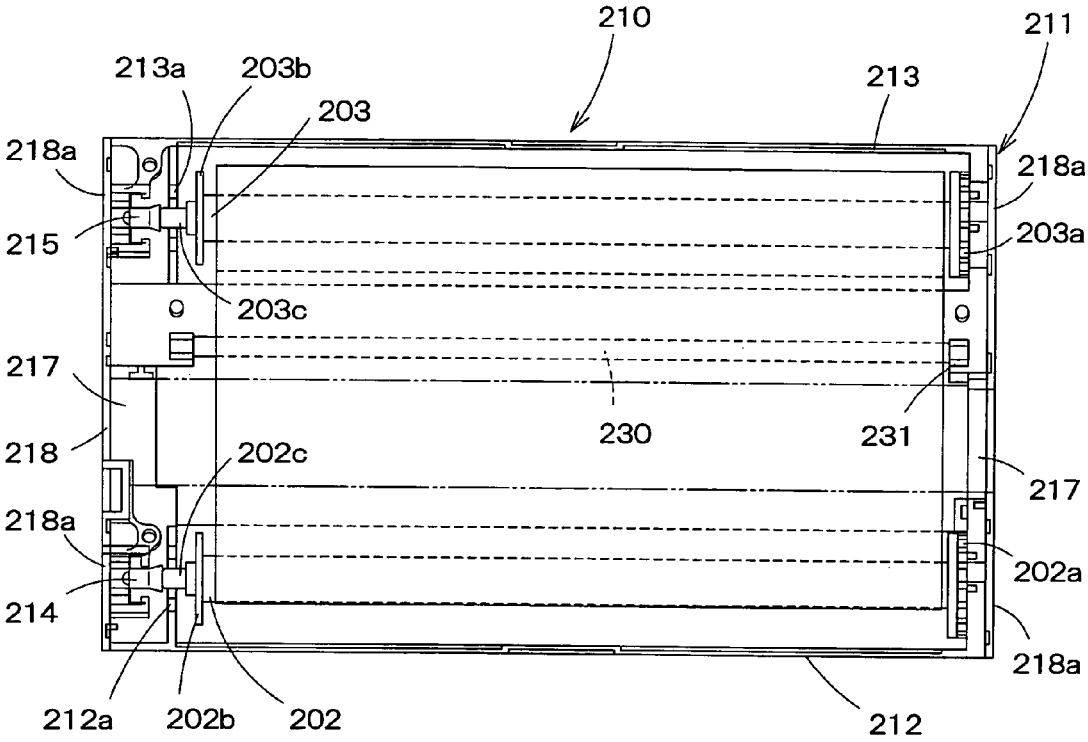
FIG. 14 is a plan view of the cassette for a thermal transfer sheet.
Figure 15:
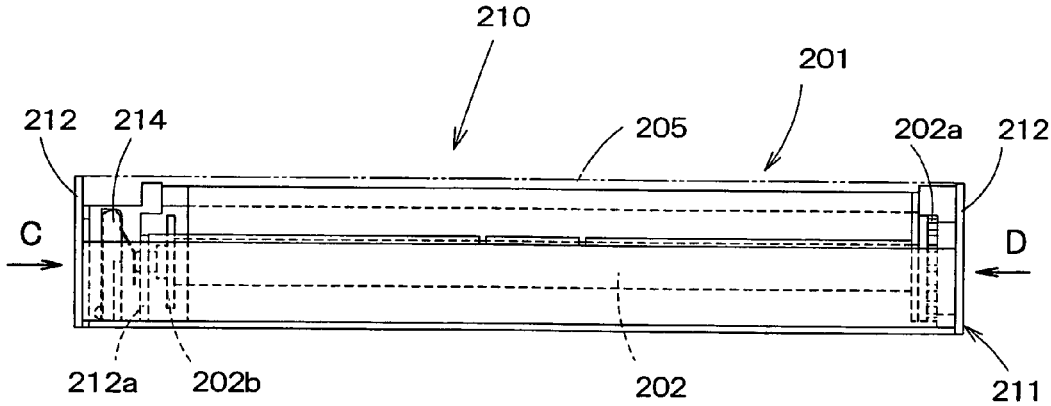
FIG. 15 is a front view of the cassette for a thermal transfer sheet.
Figure 16:
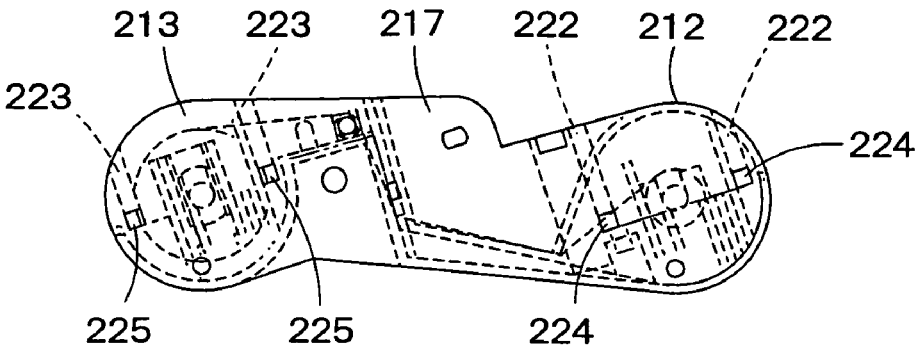
FIG. 16 is a side view of FIG. 15 viewed from the C direction.
Figure 17:
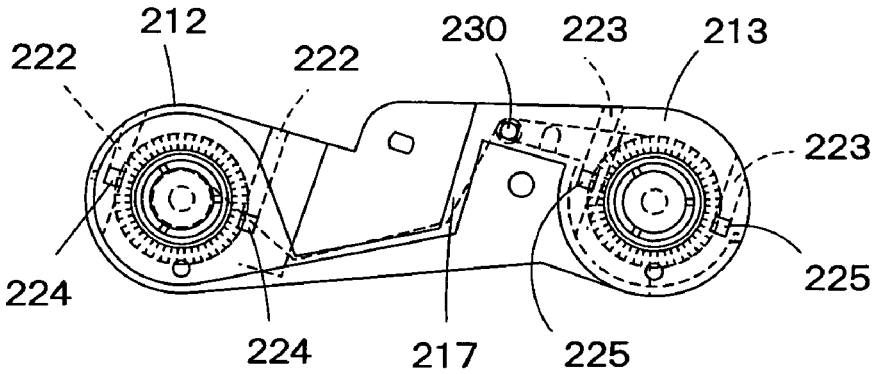
FIG. 17 is a side view of FIG. 15 viewed from the D direction.

As shown in FIGS. 14 and 15, a spring 214 is disposed on one side (left side in the drawings) of the take-up core holding part 212, which pushes the take-up core 202 to the other side (right side). A spring 215 is disposed on one side (left side) of the feeding core holding part 213, which pushes the feeding core 203 to the other side (right side). The spring 214 is disposed between a side surface defining the side part 218 of the take-up core holding part 212 and an end of the take-up core 202. The spring 215 is disposed between a side surface defining the side part 218 of the feeding core holding part 213 and an end of the feeding core 203.

For driving the thermal transfer sheet 205, driving mechanisms (not shown) are inserted from the right side part 218 in FIGS. 14 and 15. The driving mechanisms move the take-up core 202 and the feeding core 203 to the left side in FIGS. 14 and 15, in spite of the force of the springs 214 and 215. Then, the take-up core 202 and the feeding core 203 are driven in rotation.

When the driving of the thermal transfer sheet 205 is stopped, the driving mechanisms come away from the take-up core 202 and the feeding core 203, which are in turn moved right side in FIGS. 14 and 15 by the force of the springs 214 and 215. Then, the ratchets 202*a* and 203*a* of the take-up core 202 and the feeding core 203 are respectively engaged with a corresponding engagement portion (not shown) of the take-up core holding part 212 and an engagement portion (not shown) of the feeding core holding part 213, so that the take-up core 202 and the feeding core 203 are locked.

Claws 226 and 227 for securing the covers 220 221 on the core holding member 211 are disposed on outer surfaces of the side plates 220*b* and 221*b* of the covers 220 and 221. Recessed rails 222 and 223 which extend in a vertical direction are formed on inner surfaces of the side parts 218. The recessed rails 222 and 223 are engaged with the claws 226 and 227 of the covers 220 and 221. Openings 224 and 225 to receive the claws 226 and 227 are formed on ends of the recessed rails 222 and 223, respectively. When the core holding member 211 is covered with the covers 220 and 221, the covers 220 and 221 are inserted to the pair of side parts 218 of the core holding member 211 so as to make the claws 226 and 227 of the covers 220 and 221 engage with the corresponding recessed rails 222 and 223 of the side parts 218. Then, the covers 220 and 221 are pushed toward the holding part 212 and holding part 213 of the core holding member 211. The claws 226 and 227 of the covers 220 and 221 are guided by the recessed rails 222 and 223 of the side parts 218, and then fitted in the openings 224 and 225 of the side parts 218. Thus, the pair of side plates 220*b* and 221*b* of the covers 220 and 221 are locked inside the pair of side parts 218 of the core holding member 211. In this way, the covers 220 and 221 can be fixedly secured on the pair of side parts 218 of the core holding member 211.

Positions of the claws 226 and 227 of the covers 220 and 221 and the openings 224 and 225 of the side parts 218, and forms of the covers 220 and 221 and the side parts 218 of the core holding member 218 are so determined that, when the covers 220 and 221 are secured on the core holding member 211, no step is generated between upper surfaces of the middle parts 220*c* and 221*c* of the covers 220 and 221, and upper end surfaces 218*a* of the side parts 218 of the core holding member 211.

The pair of side parts 218 of the core holding member 211 are formed of flat plates extending from the feeding core holding part 213 to the take-up core holding part 212. The openings 224 and 225 of the side parts 218 are formed to have larger depths than heights of the claws 226 and 227 of the covers 220 and 221. Thus, the claws 226 and 227 of the covers 220 and 221 are not exposed to the side parts 218 of the cassette 210 for a thermal transfer sheet.

An operation of the third embodiment as constituted above is describe below.

The rod 230 is first mounted in the open supporting parts 231 of the core holding member 211. Then, the sheet body 201 having the take-up core 202, the feeding core 203, and the thermal transfer sheet 205 is mounted on the core holding member 211. The take-up core 202 and the feeding core 203 are inserted to the take-up core holding part 212 and the feeding core holding part 213, respectively.

As described above, since the open bearing 212*a* of the take-up core holding part 212 and the open bearing 213*a* of the feeding core holding part 213 are upwardly opened, the shaft 202*c* of the take-up core 202 and the shaft 203*c* of the feeding core 203 can be readily inserted to the open bearings 212*a* and 213*a*, simply by fitting the shaft 202*c* of the take-up core 202 and the shaft 203*c* of the feeding core 203 in the open bearings 212*a* and 213*a* from above.

Then, the take-up core holding part 212 of the core holding member 211 is covered with the cover 220, and the feeding core holding part 213 is covered with the cover 221. In order thereto, the covers 220 and 221 are inserted to the pair of side parts 218 of the core holding member 211 to thereby make the claws 226 and 227 of the covers 220 and 221 engage with the recessed rails 222 and 223 of the side parts 218 of the core holding member 211. Under this state, the covers 220 and 221 are pushed toward the core holding member 211. Thus, the claws 226 and 227 of the covers 220 and 221 are guided by the recessed rails 222 and 223 of the side parts 218, and then fitted in the openings 224 and 225 formed on the ends of the recessed rails 222 and 223. In this way, the take-up core holding part 212 and the feeding core holding part 213 of the core holding member 211 can be smoothly covered with the covers 220 and 221, which are then secured on the core holding member 211.

Since the open supporting parts 231 are sealed by the sealing ribs 232 of the cover 221, the rod 230 can be locked and held between the open supporting parts 231 and the sealing ribs 232.

When the covers 220 and 221 are secured on the core holding member 211, side surfaces of the cassette 210 for a thermal transfer sheet are formed only by the pair of side parts 218 of the core holding member 211. Further, the upper end surfaces 218*a* of the side parts 218 of the core holding member 211 can flush with the upper surfaces of the covers 220 and 221. The claws 226 and 227 for securing the covers 220 and 221 on the core holding member 211 are not exposed to outer surfaces of the side parts 218. Thus, the cassette 210 for a thermal transfer sheet can be compactly configured without any outwardly projecting projections. In addition, the covers 220 and 221 are rarely detached from the core holding member 221, with being fixedly secured thereon.

In this way, the sheet body 201 including the thermal transfer sheet 205 can be disposed and held in the cassette 210 for a thermal transfer sheet.

After the sheet body 201 is disposed in the cassette 210 for a thermal transfer sheet, the cassette 210 for a thermal transfer sheet is mounted on a printer. Then, the thermal transfer sheet 205 is heated by the thermal head 205*b* of the printer, so that an image is transferred from the transfer sheet 205 to the image receiving sheet 205*a* (FIG. 18).

Since the thermal transfer sheet 205 is guided by the rod 230 in the cassette 210 for a thermal transfer sheet, the thermal transfer sheet 205 is prevented from being touching or abutting on the inner surface of the cassette 210. Thus, the thermal transfer sheet 205 can be smoothly drawn out from the feeding core 203 and taken up by the take-up core 202. Further, since the rod 230 is positioned on the opposite side of the thermal head 205*b* relative to the thermal transfer sheet 205, and is positioned on the side of the core holding member 211 relative to the thermal transfer sheet 205, when the thermal transfer sheet 205 is pushed by the thermal head 205*b*, the rod 230 is also pushed toward the core holding member 211. That is, when the thermal transfer sheet 205 is pushed by the thermal head 205*b*, the rod 230 is not pushed outward the core holding member 211. Thus, the rod 230 is prevented from being detached from the core holding member 211.

As described above, according to the present invention, the covers 220 and 221 are mounted and secured inside the pair of side parts 218 of the core holding member 211. In the cassette 210 for a thermal transfer sheet, the upper end surfaces 218*a* of the side parts 218 of the core holding member 211 can flush with the upper surfaces of the covers 220 and 221 without any steps. Therefore, the cassette 210 for a thermal transfer sheet can be compactly configured without any outwardly projecting projections. In addition, when the cassette 210 for a thermal transfer sheet is fallen down or an external force is applied thereto, the covers 220 and 221 are rarely detached from the core holding member 221, with being fixedly secured thereon.

According to the present invention, covers are mounted and secured between a pair of side parts of a core holding member. In a cassette for a thermal transfer sheet, upper end surfaces of the side parts of the core holding member can flush with upper surfaces of the covers without any steps. Thus, the cassette for a thermal transfer sheet can be compactly configured without any outwardly projecting projections. In addition, when the cassette for a thermal transfer sheet is fallen down or an external force is applied thereto, the covers are rarely detached from the core holding member, with being fixedly secured thereon.

Fourth Embodiment

A fourth embodiment of the present invention is described below with reference to the drawings.

FIGS. 19 to 26 show a cassette for a thermal transfer sheet of a fourth embodiment according to the present invention.

As shown in FIGS. 19 to 24, a cassette 310 for a thermal transfer sheet contains therein a sheet body 301 including a take-up core 302, a feeding core 303, and a thermal transfer sheet 305 wound around the take-up core 302 and feeding core 303.

Figure 24:
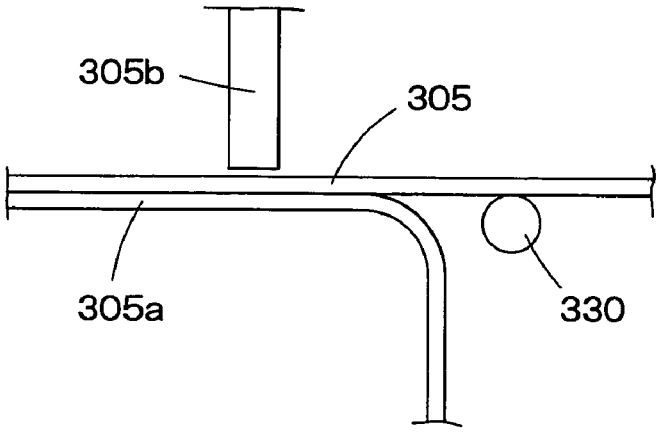
FIG. 24 is a view showing a positional relationship of a thermal transfer sheet, a rod, and a thermal head.

The thermal transfer sheet 305 in the cassette 310 for a thermal transfer sheet is drawn out from the feeding core 303 and is taken up by the take-up core 302. In the mean time, the thermal transfer sheet 305 is heated by a thermal head 305*b*, so that an image is transferred from the thermal transfer sheet 305 to an image receiving sheet 305*a* (FIG. 24).

The take-up core 302 and the feeding core 303 have flanges 302*b* and 303*b*, respectively. The take-up core 302 and the feeding core 303 have ratchets 302*a* and 303*a* for positioning, respectively.

The cassette 310 for a thermal transfer sheet for containing therein the sheet body 301 as constituted above includes a core holding member 311 having a take-up core holding part 312 for holding the take-up core 302, a feeding core holding part 313 for holding the feeding core 303, and a pair of connecting parts 317 connecting the take-up core holding part 312 and the feeding core holding part 313; and a pair of covers 320 and 321 for respectively covering the take-up core holding part 312 and the feeding core holding part 313 of the core holding member 311.

The cover 320 covers the take-up core holding part 312, while the cover 321 covers the feeding core holding part 313.

The take-up core holding part 312 of the core holding member 311 includes an open bearing 312*a* which is upwardly opened to hold a shaft 302*c* of the take-up core 302. The feeding core holding part 313 has an open bearing 313*a* which is upwardly opened to hold a shaft 303*c* of the feeding core 303.

The open bearings 312*a* and 313*a* are upwardly opened to respectively receive and support the shaft 302*c* of the take-up core 302 and the shaft 303*c* of the feeding core 303, which are fitted in the open bearings 312*a* and 313*a* from above.

A rod 330 is disposed between the pair of connecting parts 317 of the core holding member 311, for guiding the thermal transfer sheet 305 by supporting the sheet 305. The rod 330 is positioned on the opposite side of the thermal head 305*b* relative to the thermal transfer sheet 305, and is positioned on the side of the core holding member 311 relative to the thermal transfer sheet 305 (FIG. 24).

The rod 330 is rotatably supported by open supporting parts 331 which are upwardly opened and disposed on the pair of connecting parts 317, respectively. Openings of the open supporting parts 331 are covered and sealed by sealing ribs 332 formed inside the cover 321.

Since the rod 330 is positioned on the opposite side of the thermal head 305*b* relative to the thermal transfer sheet 305, and is positioned on the side of the core holding member 311 relative to the thermal transfer sheet 305, when the thermal transfer sheet 305 is pushed by the thermal head 305*b*, the rod 330 is also pushed toward the core holding member 311. That is, when the thermal transfer sheet 305 is pushed by the thermal head 305*b*, the rod 330 is not pushed outward the core holding member 311. Thus, the rod 330 is prevented from being detached from the core holding member 311.

The rod 330 is held in the open supporting parts 331. Thus, the rod 330 can be readily received in the open supporting parts 331, simply by inserting the rod 330 to the open supporting parts 331 from above. In addition, simply by covering the feeding core holding part 313 of the core holding member 311 with the cover 321, the rod 330 can be held by the open supporting parts 331 and the sealing ribs 332, with the open supporting parts 331 being sealed by the sealing ribs 332 formed on the cover 321.

Figure 20:
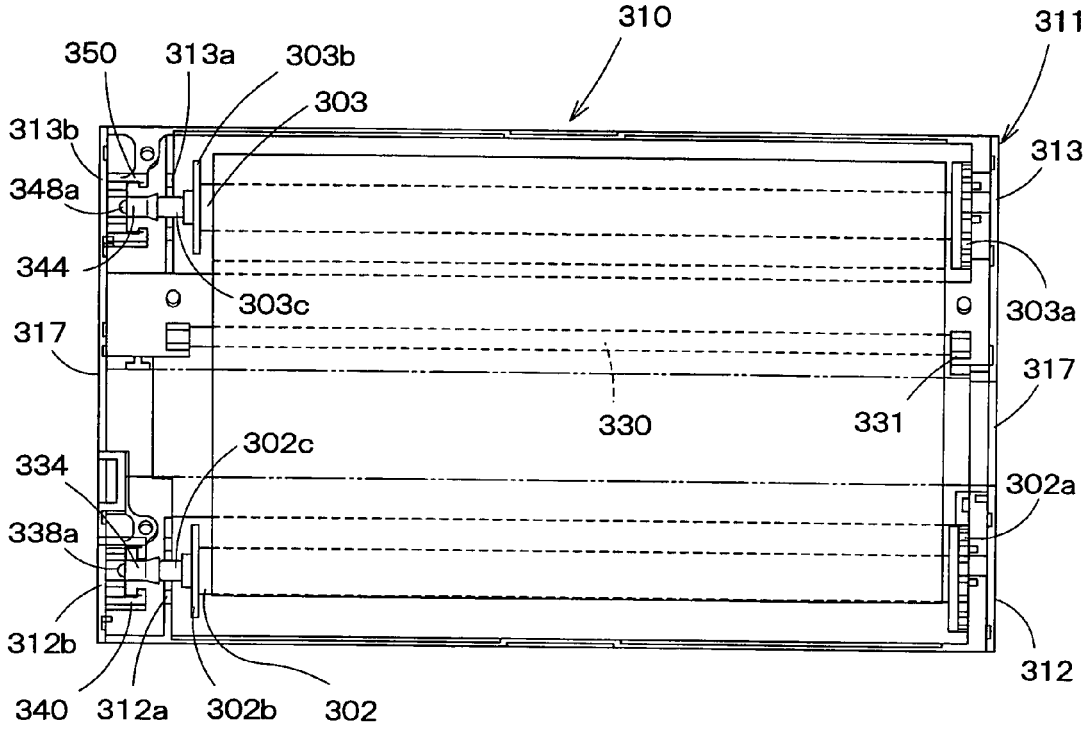
FIG. 20 is a plan view of the cassette for a thermal transfer sheet.
Figure 21:
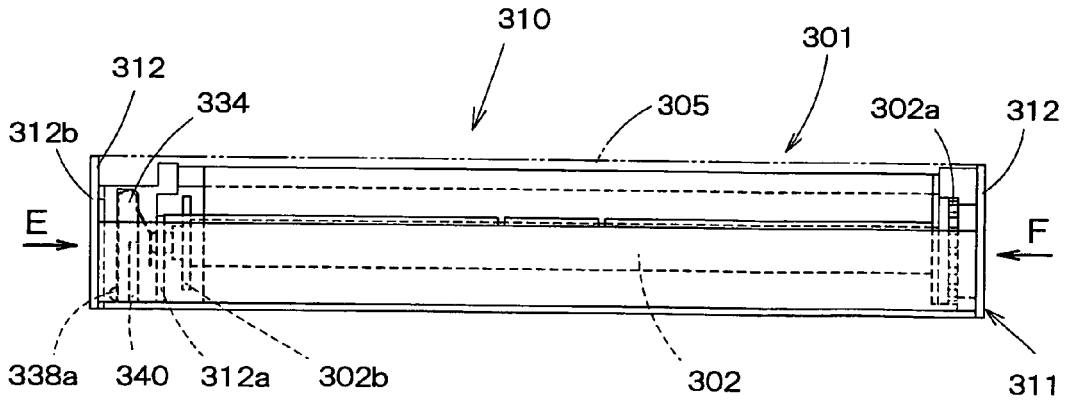
FIG. 21 is a front view of the cassette for a thermal transfer sheet.
Figure 22:
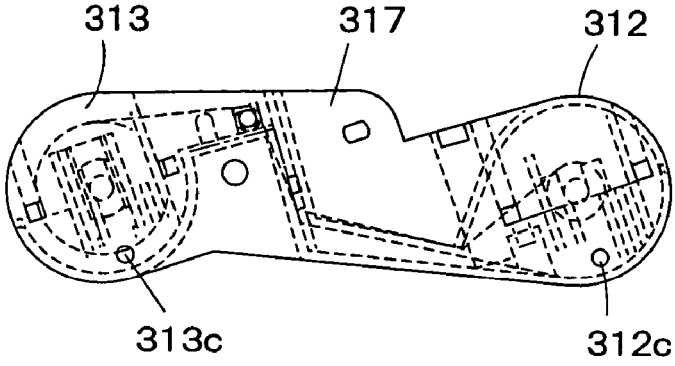
FIG. 22 is a side view of FIG. 21 viewed from the E direction.
Figure 23:
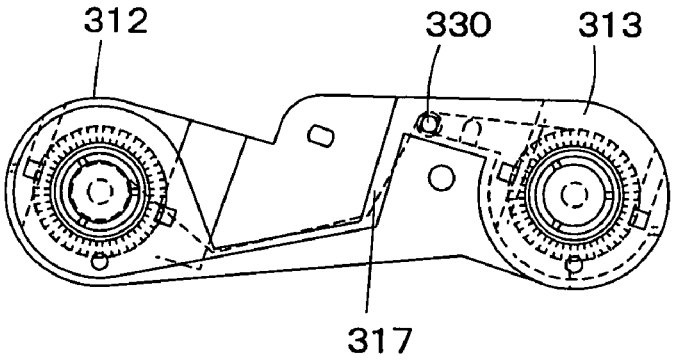
FIG. 23 is a side view of FIG. 21 viewed from the F direction.

As shown in FIGS. 20 and 21, the take-up core holding part 312 has a wall surface 312*b*. A spring holder 340 is disposed between the wall surface 312*b* and the open bearing 312*a*. A spring 334 is provided within the spring holder 340, which pushes the take-up core 302 in one direction (right side). The feeding core holding part 313 has a wall surface 313*b*. A spring holder 350 is disposed between the wall surface 313*b* and the open bearing 313*a*. A spring 344 is provided within the spring holder 350, which pushes the feeding core 303 in one direction (right side).

Figure 26:
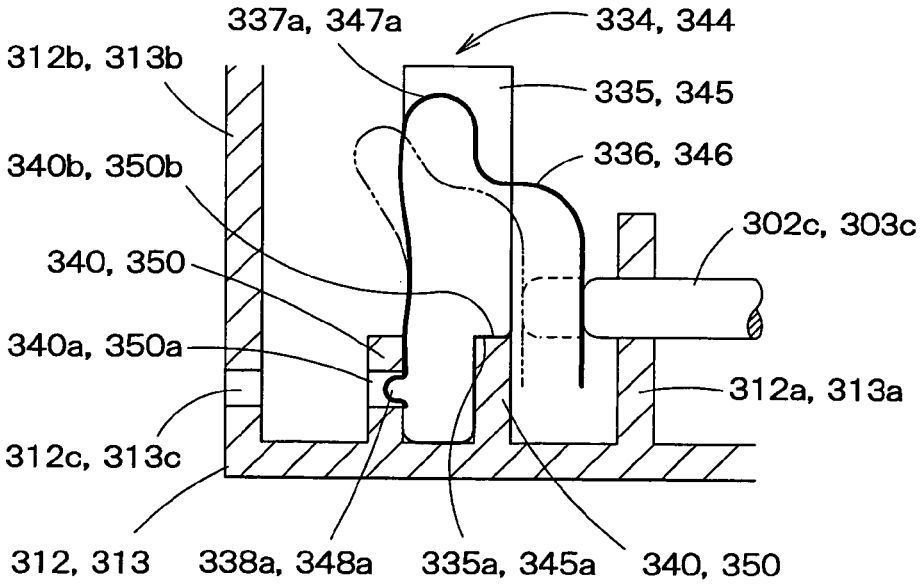
FIG. 26 is a cross-sectional view showing an attachment portion of the spring.

As shown in FIG. 20, the spring holders 340 and 350 surround and hold the springs 334 and 344. The spring holders 340 and 350 have substantially rectangular shapes in a plan view which are opened to the side of the open bearings 312*a* and 313*a* of the holding parts 312 and 313. As shown in FIG. 26, the spring holder 340 and 350 have holes 340*a* and 350*a* formed thereon on the sides of the wall surfaces 312*b* and 313*b* of the holding parts 312 and 313. Apertures 312*c* and 313*c* are formed on the wall surface 312*b* of the holding part 312 and the wall surface 313*b* of the holding part 313 of the core holding member 311. The apertures 312*c* and 313*c* are formed such that the apertures 312*c* and 313*c* are aligned with the holes 340*a* and 350*a* of the spring holders 340 and 350.

Figure 25:
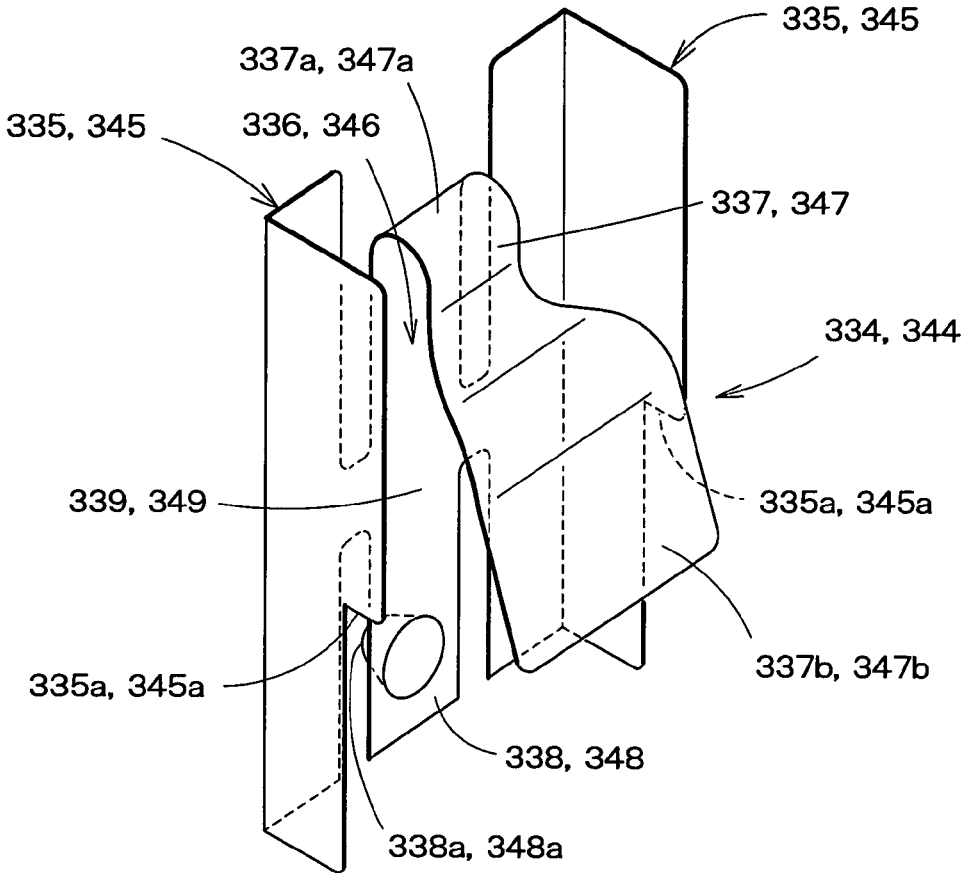
FIG. 25 is a perspective view of a spring.

As shown in FIG. 25, the springs 334 and 344 include flat spring portions 336 and 346, and two pairs of shoulder portions 335 and 345 disposed on both sides of the flat spring portions 336 and 346, respectively. The flat spring portions 336 and 346 have core pushing springs 337 and 347 for pushing the cores 302 and 303, fixing springs 338 and 348 for detachably attaching the springs 334 and 344 on the spring holders 340 and 350, and connecting parts 339 and 349 formed between the core pushing springs 337 and 347 and fixing springs 338 and 348. The flat spring portions 336 and 346 are connected to the shoulder portions 335 and 345 by the connecting parts 339 and 349. The flat spring portions 336 and 346 and the shoulder portions 335 and 345 are integrally formed to define the springs 334 and 344.

The core pushing springs 337 and 347 of the springs 334 and 344 are formed by bending flat plates at bent portions 337*a* and 347*a*. Abutting surfaces 337*b* and 347*b* adjacent to the bent portions 337*a* and 347*b* abut on the shafts 302*c* and 303*c* of the cores 302 and 303. The abutting surfaces 337*b* and 347*b* are wider than the connecting parts 339 and 349 extending from the bent portions 337*a* and 347*a*.

The abutting surfaces 337*b* and 347*b* of the core pushing springs 337 and 347 can be readily swung about the bent portions 337*a* and 347*a*. The spring holders 340 and 350 have substantially the same height as that of the connecting parts 339 and 349 of the spring 334 and 344. The core pushing springs 337 and 347 as a whole can be readily swung about the connecting parts 339 and 349 toward the wall surfaces 312*b* and 313*b* of the holding parts 312 and 313. Thus, as shown in the two-dot chain lines in FIG. 26, the abutting surfaces 337*b* and 347*b* of the core pushing springs 337 and 347 can be moved from the side of the open bearings 312*a* and 313*a* of the holding parts 312 and 313 toward the side of the wall surfaces 312*b* and 313*b*. As described above, since the spring holders 340 and 350 have their ends opened to the side of the shafts 302*c* and 303*c* of the cores 302 and 303 to form substantially the rectangular shapes, when the abutting surfaces 337*b* and 347*b* are widely moved, the spring holders 340 and 350 are not interfered by the abutting surfaces 337*b* and 347*b*.

When the springs 334 and 344 are attached in the spring holders 340 and 350, the springs 334 and 344 are resiliently deformed to thereby continuously push the shaft 302*c* and 303*c* of the cores 302 and 303 in a direction away from the springs 334 and 344.

Outwardly projecting projections 338*a* and 348*a* are disposed near lower ends of the fixing springs 338 and 348. As described below, when the springs 334 and 344 are attached in the spring holders 340 and 350, the projections 338*a* and 348*a* of the fixing springs 338 and 348 of the springs 334 and 344 are fitted in the holes 340*a* and 350*a* of the spring holders 340 and 350.

As described above, the fixing springs 338 and 348 can be swung about the connecting parts 339 and 349. Thus, when the springs 334 and 344 are attached in the spring holders 340 and 350, the fixing springs 338 and 348 are swung about the connecting parts 339 and 349. Under this state, the projections 338*a* and 348*a* of the fixing springs 338 and 348 are slid along inside wall surfaces of the spring holders 340 and 350.

As shown in FIG. 25, the shoulder portions 335 and 345 of the springs 334 and 344 are formed in L shaped configurations to enhance a rigidity of the springs 335 and 345 as a whole. Cutouts 335*a* and 345*a* are formed in lower portions of side surfaces of the shoulders 335 and 345. The cutouts 335*a* and 345*a* are formed to have the same depths as heights of the upper end portions 340*b* and 350*b* of the spring holders 340 and 350. Thus, simply by pushing the springs 334 and 344 into the spring holders 340 and 350, the cutouts 335*a* and 345*a* are engaged with the upper end portions 340*b* and 350*b* of the spring holders 340 and 350 so that the springs 340 and 350 are automatically positioned. In addition, such a state can be visually checked.

Upper ends of the shoulder portions 335 and 345 are positioned above the bent portions 337*a* and 347*a* of the core pushing springs 337 and 347 which are upper ends of the flat spring portions 336 and 346. That is, when the upper ends of the springs 334 and 344 are pushed toward the spring holders 340 and 350 by means of a pushing member or a finger so as to attach the springs 334 and 344 in the spring holders 340 and 350, the pushing member or finger does not touch the bent portions 337*a* and 347*a* of the fragile flat spring portions 337 and 347, but only touches the upper ends of the rigid shoulder portions 335 and 345 having L-shaped plan surfaces.

For driving the thermal transfer sheet 305, driving mechanisms (not shown) are inserted from the right sides of the take-up core holding part 312 and the feeding core holding part 313 in FIGS. 20 and 21. The driving mechanisms move the take-up core 302 and the feeding core 303 to the left side in FIGS. 20 and 21, in spite of the force of the springs 334 and 344. Then, the take-up core 302 and the feeding core 303 are driven in rotation.

When the driving of the thermal transfer sheet 305 is stopped, the driving mechanisms come away from the take-up core 302 and the feeding core 303 which are in turn moved right side in FIGS. 20 and 21 by the force of the springs 334 and 344. Then, the ratchets 302*a* and 303*a* of the take-up core 302 and the feeding core 303 are engaged with a corresponding engagement portion (not shown) of the take-up core holding part 312 and an engagement portion (not shown) of the feeding core holding part 313, so that the take-up core 302 and the feeding core 303 are locked.

Recessed rails 322 and 323 extending in a vertical direction are respectively formed on inner surfaces of the holding part 312 and the holding part 313 of the core holding member 311. The covers 320 and 321 are provided with claws 324 and 325 to be fitted in the recessed rails 322 and 323, respectively. When the core holding part 311 is covered with the covers 320 and 321, the claws 324 and 325 of the covers 320 and 321 are engaged with the corresponding recessed rails 322 and 323 of the holding part 312 and the holding part 313. Thus, the holding part 312 and the holding part 313 of the core holding member 311 can be smoothly covered with the covers 320 and 321.

An operation of the fourth embodiment as constituted above is describe below.

The rod 330 is first mounted in the open supporting parts 331 of the core holding member 311.

Then, an attachment and a detachment operations of the springs 334 and 344 are described below. When the springs 334 and 344 are broken and incapable of being used, the broken springs 334 and 344 are detached from the spring holders 340 and 350, and new springs 334 and 344 are attached therein.

In order to detach the springs 334 and 344 from the spring holders 340 and 350, elongated bars are inserted through from the apertures 312*c* and 313*c* of the core holding member 311 to detach the projections 338*a* and 348*a* of the springs 334 and 344 from the holes 340*a* and 350*a* of the spring holders 340 and 350. Then, the springs 334 and 344 are withdrawn from the spring holders 340 and 350. Since the fixing springs 338 and 348 having the projections 338*a* and 348*a* can be swung about the connecting parts 339 and 349, the projections 338*a* and 348*a* can be readily detached from the holes 340*a* and 350*a* of the spring holders 340 and 350. In this manner, the springs 334 and 344 can be detached from the spring holders 340 and 350.

Next, new springs 334 and 344 are pushed in the spring holders 340 and 350. The fixing springs 338 and 348 of the springs 334 and 344 are swung about the connecting parts 339 and 349, and the projections 338*a* and 348*a* are slid along the inner wall surfaces of the spring holders 340 and 350. Thus, the springs 334 and 344 can be readily inserted in the spring holders 340 and 350.

During the attachment of the springs 334 and 344, the upper ends of the shoulder portions 335 and 345 of the springs 334 and 344 are positioned above the bent portions 337*a* and 347*a* which are the upper ends of the core pushing springs 337 and 347. Thus, when the springs 334 and 344 are pushed to the spring holders 340 and 350, only the highly rigid shoulder portions 335 and 345 are touched by the pushing member or finger, while the bent portions 337*a* and 347*a* of the fragile core pushing springs 337 and 347 of the flat spring portions 336 and 346 are untouched. Therefore, the core pushing springs 337 and 347 can be securely protected.

Then, the cutouts 335*a* and 345*a* of the shoulder portions 335 and 345 of the springs 334 and 344 are engaged with the upper ends 340*b* and 350*b* of the spring holders 340 and 350, whereby the springs 334 and 344 are automatically positioned relative to the spring holders 340 and 350. Engagements between the cutouts 335*a* and 345*a* and the upper ends 340*b* and 350*b* can be visually checked. Thus, the springs 334 and 344 can be readily positioned relative to the spring holders 340 and 350. In addition, damage of the finger and breakage of the springs 334 and 344, which are caused by excessively pushing the springs 334 and 344, can be prevented.

When the springs 334 and 344 are positioned on predetermined locations in the spring holders 340 and 350, the fixing springs 338 and 348 of the springs 334 and 344, which have been in the swung positions, are returned to the original positions, whereby the projections 338*a* and 348*a* of the fixing springs 338 and 348 are fitted in the holes 340*a* and 350*a* of the spring holders 340 and 350. In this manner, the springs 334 and 344 are positioned and secured in the spring holders 340 and 350. It can be checked whether the projections 338*a* and 348*a* are suitably fitted in the holes 340*a* and 350*a*, through the apertures 312*c* and 313*c* of the holding parts 312 and 313.

Then, the sheet body 301 having the take-up core 302, the feeding core 303, and the thermal transfer sheet 305 is mounted on the core holding member 311. The take-up core 302 and the feeding core 303 are inserted to the take-up core holding part 312 and the feeding core holding part 313, respectively.

As described above, since the open bearing 312*a* of the take-up core holding part 312 and the open bearing 313*a* of the feeding core holding part 313 are upwardly opened, the shaft 302*c* of the take-up core 302 and the shaft 303*c* of the feeding core 303 can be readily inserted to the open bearings 312*a* and 313*a*, simply by fitting the shaft 302*c* of the take-up core 302 and the shaft 303*c* of the feeding core 303 in the open bearings 312*a* and 313*a* from above.

Then, the take-up core holding part 312 of the core holding member 311 is covered with the cover 320, and the feeding core holding part 313 is covered with the cover 321. By fitting the projections 324 and 325 of the covers 320 and 321 in the recessed rails 322 and 323 of the holding part 312 and holding part 313 of the core holding member 311, the take-up core holding part 312 and the feeding core holding part 313 of the core holding member 311 can be smoothly covered with the covers 320 and 321. Since the open supporting parts 331 are sealed by the sealing ribs 332 of the cover 321, the rod 330 can be locked and held between the open supporting parts 331 and the sealing ribs 332.

In this manner, the sheet body 301 having the thermal transfer sheet 305 can be disposed and held in the cassette 310 for a thermal transfer sheet.

After the sheet body 301 is disposed in the cassette 310 for a thermal transfer sheet, the cassette 310 for a thermal transfer sheet is mounted on a printer. Then, the thermal transfer sheet 305 is heated by the thermal head 305*b* of the printer, so that an image is transferred from the transfer sheet 305 to the image receiving sheet 305*a* (FIG. 24).

Since the thermal transfer sheet 305 is guided by the rod 330 in the cassette 310 for a thermal transfer sheet, the thermal transfer sheet 305 is prevented from touching or abutting on the inner surface of the cassette 310. Thus, the thermal transfer sheet 305 can be smoothly drawn out from the feeding core 303 and taken up by the take-up core 302. Further, since the rod 330 is positioned on the opposite side of the thermal head 305*b* relative to the thermal transfer sheet 305, and is positioned on the side of the core holding member 311 relative to the thermal transfer sheet 305, when the thermal transfer sheet 305 is pushed by the thermal head 305*b*, the rod 330 is also pushed toward the core holding member 311. That is, when the thermal transfer sheet 305 is pushed by the thermal head 305*b*, the rod 330 is not pushed outward the core holding member 311. Thus, the rod 330 is prevented from being detached from the core holding member 311.

When the cassette 310 for a thermal transfer sheet is not normally operated, it can be checked whether the projections 338*a* and 348*a* of the springs 334 and 344 are suitably fitted in the holes 340*a* and 350*a* of the spring holder 340 and 350, through the apertures 312*c* and 313*c* of the holding parts 312 and 313 of the core holding member 311, as described above. Thus, without detaching the covers 320 and 321 from the core holding member 311, it can checked whether the springs 334 and 344 are present, or properly attached in the spring holders 340 and 350. As a result, damages of the claws of the covers 320 and 321 can be prevented, which may be caused by a frequent attachment and detachment of the covers 320 and 321 from the core holding member 311.

As described above, according to the present invention, since the cutouts 335*a* and 345*a* to be engaged with the spring holders 340 and 350 are formed on the springs 334 and 344, the springs 334 and 344 can be readily positioned on the spring holders 340 and 350 by visually checking their state. Therefore, excessive pushing of the springs can be prevented whereby damage of the fingers or the like can be prevented.

When the springs 334 and 344 are positioned on the spring holders 340 and 350, the projections 338*a* and 348*a* of the springs 334 and 344 are fitted in the holes 340*a* and 350*a* of the spring holders 340 and 350. Thus, the springs 334 and 344 are secured in position in the spring holders 340 and 350. The fixing springs 338 and 348 having the projections 338*a* and 348*a* can be swung. Thus, upon attachment and detachment of the springs 334 and 344, the springs 334 and 344 are attached in or detached from the spring holders 340 and 350, without the projections 338*a* and 348*a* being caught by the inner wall surfaces of the spring holders 340 and 350.

When the springs 334 and 344 are pushed to be attached in the spring holders 340 and 350, only the highly rigid shoulder portions 335 and 345 having L-shaped plan surfaces of the springs 334 and 344 are touched by the pushing member or a finger, while the fragile flat spring portions 336 and 346 are untouched. Therefore, the flat spring portions 336 and 346 can be protected, upon attachment and detachment of the springs 334 and 344.

In addition, it can be checked whether the projections 338*a* and 348*a* of the springs 334 and 344 are suitably fitted in the holes 340*a* and 350*a* of the spring holders 340 and 350, through the apertures 312*c* and 313*c*. Therefore, whether the springs 334 and 344 are attached in position can be checked, with the core holding member 311 being covered with the covers 320 and 321.

According to the present invention, since cutouts to be engaged with a spring holder are formed on a spring, the spring can be readily positioned on the spring holder.

A projection is disposed on a spring, which is fitted in a hole of a spring holder when the spring is positioned in the spring holder. Thus, the spring can be fixedly secured in position.

Further, upper ends of shoulder portions are positioned above an upper end of a flat spring portion, when a spring is pushed to be attached on a spring holder by means of a pushing member, for example. Thus, only the highly rigid shoulder portions are touched by the pushing member, while the fragile flat spring portion is untouched. Therefore, the spring can be prevented from being damaged during attachment thereof.

The invention claimed is:

1. A cassette for a thermal transfer sheet, for containing therein a sheet body including a take-up core, a feeding core, and a thermal transfer sheet which is wound around the take-up core and the feeding core and is heated by a thermal head, comprising:

a core holding member including a take-up core holding part, a feeding core holding part, and a pair of connecting parts connecting the take-up core holding part and the feeding core holding part;

covers for respectively covering the take-up core holding part and the feeding core holding part; and a rod disposed between the pair of connecting parts of the core holding member, for guiding the thermal transfer sheet by supporting the sheet; wherein the rod is positioned on the opposite side of the thermal head relative to the thermal transfer sheet, and is positioned on the side of the core holding member relative to the thermal transfer sheet.

2. The cassette for a thermal transfer sheet according to claim 1, wherein open supporting parts for supporting the rod are respectively disposed on the pair of connecting parts of the core holding member, and openings of the open supporting parts are covered with sealing ribs formed on the cover.

3. The cassette for a thermal transfer sheet according to claim 1, wherein each of the take-up core holding part and the feeding core holding part is provided with an open bearing which is opened to support the corresponding take-up core or the feeding core.

4. The cassette for a thermal transfer sheet according to claim 1, wherein recessed rails are formed on an inner surface of the core holding member, and projections to be fitted in the recessed rails are formed on the respective covers.

5. The cassette for a thermal transfer sheet according to claim 1, wherein each of the covers is provided with claws, the core holding member is provided with openings in which the claws are fitted to secure the respective covers to the core holding member, and the openings of the core holding member are positioned near a beam member for reinforcing the core holding member.

6. The cassette for a thermal transfer sheet according to claim 5, wherein the beam member is formed by the take-up core holding part.

7. The cassette for a thermal transfer sheet according to claim 5, wherein the beam member is formed by the feeding core holding part.

8. The cassette for a thermal transfer sheet according to claim 5, wherein the beam member is disposed on the core holding member separately from the take-up core holding part and the feeding core holding part.

9. A cassette for a thermal transfer sheet, for containing therein a sheet body including a take-up core, a feeding core, and a thermal transfer sheet which is wound around the take-up core and the feeding core and is heated by a thermal head, comprising:

a core holding member including a take-up core holding part and a feeding core holding part; and covers for respectively covering the take-up core holding part and the feeding core holding part; wherein the core holding member is provided with a pair of side parts extending from the feeding core holding part to the take-up core holding part, and each of the covers is secured inside the pair of side parts.

10. The cassette for a thermal transfer sheet according to claim 9, wherein the pair of side parts are respectively made of flat plates.

11. The cassette for a thermal transfer sheet according to claim 9, wherein each of the covers is provided with a pair of side plates, and the pair of side plates of the cover are locked inside the pair of side parts of the core holding member.

12. A cassette for a thermal transfer sheet, for containing therein a sheet body including a take-up core, a feeding core, and a thermal transfer sheet which is wound around the take-up core and the feeding core and is heated by a thermal head, comprising:

a core holding member including a take-up core holding part, a feeding core holding part, and a pair of connecting parts connecting the take-up core holding part and the feeding core holding part; and covers for respectively covering the take-up core holding part and the feeding core holding part; wherein each of the take-up core holding part and the feeding core holding part of the core holding member is provided with a spring holder, and a spring is provided within the spring holder for pushing the corresponding core in one direction.

13. The cassette for a thermal transfer sheet according to claim 12, wherein the spring comprises a flat spring portion and a pair of shoulder portions disposed on both sides of the flat spring portion.

14. The cassette for a thermal transfer sheet according to claim 13, wherein each of the shoulder portions is provided with a cutout to be engaged with the spring holder to position the spring.

15. The cassette for a thermal transfer sheet according to claim 13, wherein the flat spring portion of the spring is provided with an outwardly projecting projection, the spring holder is provided with a hole to be engaged with the projection of the flat spring portion, and the spring is secured on the spring holder by fitting the projection in the hole.

16. The cassette for a thermal transfer sheet according to claim 15, wherein each of the take-up core holding part and the feeding core holding part of the core holding member is provided with an aperture through which an observer is able to observe whether the projection of the spring is fitted in the hole of the spring holder.

17. The cassette for a thermal transfer sheet according to claim 13, wherein upper ends of the shoulder portions are positioned above an upper end of the flat spring portion.

* * * * *